US005380626A

United States Patent [19]

Nakamura et al.

[11] Patent Number: 5,380,626

[45] Date of Patent: Jan. 10, 1995

[54] METHOD FOR PROCESSING A SILVER HALIDE PHOTOGRAPHIC MATERIAL USING A PROCESSING SOLUTION HAVING A BLEACHING ABILITY CONTAINING ONE OF AN AMIDINE OR A BISGUANIDINE COMPOUND

[75] Inventors: Koichi Nakamura; Yoshiharu Yabuki, both of Kanagawa, Japan

[73] Assignee: Fuji Photo Film Co., Ltd., Kanagawa, Japan

[21] Appl. No.: 42,800

[22] Filed: Apr. 6, 1993

[30] Foreign Application Priority Data

Apr. 6, 1992 [JP] Japan ..... 4-112377

[51] Int. Cl.[6] ..... G03C 7/00; G03C 5/44; G03C 5/18; G03C 5; G03C 38

[52] U.S. Cl. ..... 430/393; 430/429; 430/430; 430/493; 430/461; 430/933

[58] Field of Search ..... 430/418, 430, 460, 461, 430/462, 931, 393, 400, 428, 429, 453, 455, 933, 963

[56] References Cited

U.S. PATENT DOCUMENTS

| | | | |
|---|---|---|---|
| 2,174,494 | 9/1939 | Barnes | 95/88 |
| 2,260,665 | 10/1941 | Ham | 430/453 |
| 2,461,987 | 2/1949 | Knott et al. | 430/429 |
| 2,657,140 | 10/1953 | Kessels | 430/933 |
| 3,743,531 | 7/1973 | Ducharme | 430/933 |
| 4,144,068 | 3/1979 | Ishibashi et al. | 430/393 |
| 4,322,493 | 3/1982 | Shibaoka et al. | 430/462 |
| 4,500,632 | 2/1985 | Ohmura et al. | 430/429 |
| 4,707,434 | 11/1987 | Koboshi et al. | 430/461 |
| 4,717,647 | 1/1988 | Abe et al. | 430/430 |
| 4,908,300 | 3/1990 | Koboshi et al. | 430/460 |
| 5,139,920 | 8/1992 | Hayashi et al. | 430/461 |

FOREIGN PATENT DOCUMENTS

| | | | |
|---|---|---|---|
| 0427204 | 5/1991 | European Pat. Off. | 430/460 |
| 49-40943 | 4/1974 | Japan | 430/460 |
| 49-26900 | 7/1974 | Japan | 430/460 |
| 49-84440 | 8/1974 | Japan . | |
| 1035447 | 2/1986 | Japan | 430/429 |
| 61-51147 | 3/1986 | Japan . | |
| 62-129854 | 6/1987 | Japan . | |
| 62-135833 | 6/1987 | Japan . | |
| 1158443 | 6/1989 | Japan | 430/460 |
| 1-211757 | 8/1989 | Japan . | |
| 1-213653 | 8/1989 | Japan . | |
| 3062032 | 3/1991 | Japan | 430/461 |
| 3063647 | 3/1991 | Japan | 430/430 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A method for forming an image in a silver halide color photographic material comprising a support having thereon at least one light-sensitive silver halide emulsion layer, which comprises imagewise exposing the silver halide color photographic material, color developing the exposed material and then subjecting the developed material to a desilverization treatment, wherein the desilverization treatment is carried out using a processing solution having a bleaching ability and containing at least one of an amidine compound or a bisguanidine compound and a ferric salt of an organic acid, and also a method for processing a silver halide photographic material wherein processing is additionally carried out in the presence of a stilbene fluorescent brightener using a desilverization bath containing at least one of an amidine compound or a bisguanidine compound.

20 Claims, No Drawings

METHOD FOR PROCESSING A SILVER HALIDE PHOTOGRAPHIC MATERIAL USING A PROCESSING SOLUTION HAVING A BLEACHING ABILITY CONTAINING ONE OF AN AMIDINE OR A BISGUANIDINE COMPOUND

FIELD OF THE INVENTION

This invention relates to a method for processing a silver halide photographic material, and more particularly to a method for processing a silver halide photographic material where stain scarcely occurs. It also relates to a method for processing a silver halide photographic material where the amount of waste liquor produced on processing can be reduced and which is suitable for use in leisure processing.

BACKGROUND OF THE INVENTION

The processing of silver halide photographic materials, for example the processing of silver halide color photographic materials comprises generally a color development stage and a desilverization stage. In the desilverization stage, developed silver formed during the course of color development is oxidized by a bleaching agent having an oxidizing effect on a silver salt (bleaching), and the silver salt together with unexposed silver halide is converted into soluble salts using a fixing agent and removed from the light-sensitive layers. Ferric ion complex salts (e.g., iron(III) complex salts of aminopolycarboxylic acids) are mainly used as the bleaching agents, and thiosulfates are usually used as the fixing agents.

Bleaching and fixing can be separately carried out as a bleaching stage and a fixing stage, or bleaching and fixing can be simultaneously carried out as a bleaching-fixing stage. The details of these processing stages are described in James, *The Theory of Photographic Process*, Fourth Edition (1977).

Generally, the above processing stages are carried out using automatic processors. Particularly, small-size automatic processors called mini-laboratories have been installed in shops, and rapid processing service to customers has spread in recent years. The bleaching agent and the fixing agent are used in the same bath as a bleaching-fixing bath in the processing of color paper because of the miniaturization of the processors and the demand for rapid processing.

Further, the reduction in the replenishment rates of processing solutions has been positively made in the above processing stages from the viewpoints of resource saving and the preservation of the environment. However, when the replenishment rate of developing solution is merely reduced, a problem occurs in that development activity is lowered by the accumulation of matter dissolved out from the light-sensitive materials, particularly the accumulation of iodide ion and bromide ion which are intense development restrainers. As a result, rapid processing is deteriorated. JP-A-58-95345 (the term "JP-A" as used herein means an "unexamined published Japanese patent application"), JP-A-59-232342, JP-A-61-70552 and WO 87-04534 disclose a method using silver halide light-sensitive materials having a high silver chloride content to reduce the accumulation of iodide ion and bromide ion and to thereby achieve rapid processing. This method is considered to be an effective method which allows rapid processing to be carried out even in the case of a low replenishment rate for the developing solutions.

JP-A-4-443 discloses that the dye image has excellent stability, and the reduction in the replenishment rate as well as ultra-high rapid processing can be achieved when silver halide light-sensitive materials having a high silver chloride content are processed with color developing solutions containing hydroxyalkyl-substituted p-phenylenediamine derivatives with a specific structure as color developing agents.

A marked improvement in process rapidity and an improvement in the stability of processing solutions have been required in the bleaching-fixing stage. However, there is the problem that when rapid bleaching-fixing processing is carried out after rapid color development, developing agents (which can be removed in a conventional bleaching-fixing stage) or sensitizing dyes and antihalation dyes used in the light-sensitive materials are not sufficiently removed. As a result, stain is formed on an image after processing, that is, a white area on the image is stained and the image is not good. Accordingly, a processing solution and a processing method which solve the above-described problem have been required.

JP-A-49-84440, JP-A-61-51147, JP-A-62-129854, JP-A-62-135833, JP-A-1-211757 and JP-A-1-213653 disclose that onium salts such as typically quaternary ammonium salts or organic bases of conjugate acids are present as a bleaching accelerator in a bleaching bath to accelerate the desilverization treatment in the processing of conventional silver halide light-sensitive materials containing silver chlorobromide or silver iodobromide. Further, JP-A-1-211757 discloses that bleaching accelerators are useful particularly when reversal color light-sensitive materials containing a high silver content emulsion for photographing and color negative light-sensitive materials containing a high silver content emulsion for photographing are processed.

However, these patent specifications disclose nothing concerning a method for accelerating the rapid removal of developing agents, coloring materials such as sensitizing dyes, other dyes, etc. Further, it has been found that some of these desilverization accelerators do not operate well in rapid processing including the subsequent rinsing stage because the stability of the image is deteriorated when the time of the subsequent rinsing or stabilization stage is shortened.

There is a possibility that the removal of the color developing agents from the light-sensitive materials in the bleaching-fixing bath and the coloring materials such as sensitizing dyes, other dyes, etc. is insufficiently achieved when rapid processing is carried out in the desilverization stage such as in the bleaching-fixing stage and the reduction of the replenishment rate of the processing solution is achieved in this stage to process rapidly photographic materials such as color photographic materials and to simplify the processing thereof. Further, the shorter the time of the subsequent rinsing or stabilization stage, the more the load of removal of undesired materials in the desilverization stage such as the bleaching-fixing stage is increased.

When rapid processing of all of the processing stages is contemplated as mentioned above, the problem with regard to the deterioration (staining) of the white area on the image caused by undesired components left behind in the light-sensitive materials becomes markedly apparent. Particularly, the problem with regard to the removal of the developing agents is serious. When the time of bleaching-fixing is shortened, developing agents are left behind in the light-sensitive materials, and stain tends to be formed on the image. It has been found that a low pH, such as a pH not higher than 5, is favorable in the removal of the developing agents in the bleaching-fixing stage. However, processing over a long period of 20 seconds or longer at a low pH is not preferred because maximum density is reduced. Further, when the pH is extremely low, removal of the dyes and the sensitizing dyes is retarded, and hence extremely low pH is disadvantageous in solving the problem with regard to stain on the image.

Accordingly, sufficient removal of the developing agents, the dyes and the sensitizing dyes in the rapid processing of the photographic materials has been desired. Particularly, development of a processing method capable of sufficiently removing these compounds in the desilverization stage such as the bleaching stage, the fixing stage or the bleaching-fixing stage, has been desired.

SUMMARY OF THE INVENTION

An object of the present invention is to provide a method for processing a color photographic material where only a small amount of color developing agents remain behind in the color photographic material after processing in the ultra-high rapid processing of the color photographic material using color developing agents and which provides an image on which stain during storage over a long period of time is hardly formed.

Another object of the present invention is to provide a method for processing s photographic material where stain caused by dyes and sensitizing dyes left behind in the ultra-high rapid processing of the photographic material is scarcely formed.

Still another object of the present invention is to provide a method for processing a color photographic material which scarcely causes a variation to occur in photographic performance during processing in the ultra-high processing of the color photographic material with a low replenishment rate and which can provide a color image which has a good resolving power even after storage over a long period of time and where stain on the white area thereof is scarcely formed.

The term "stain" as used herein refers to coloration formed in the white area of the image which is caused by the reaction of the color developing agents left behind in the color photographic material after processing during storage (e.g., during storage under high humidity conditions) and also to coloration formed in the white area of the image caused by coloration of materials such as sensitizing dyes and other dyes left behind in the photographic material immediately after processing.

With a view of solving the problems as described above, research has been conducted to reduce the amounts of undesired materials left behind in the photographic material after processing and to develop a method for accelerating the removal of the undesired materials during the processing of the photographic material. As a result, it has been found that the above-described objects of the present invention can be achieved by the following embodiments of the present invention.

(1) In our embodiment, the present invention provides a method for forming an image in a silver halide color photographic material comprising a support having thereon at least one light-sensitive silver halide emulsion layer which comprises image-wise exposing the silver halide color photographic material, color developing the exposed material and then subjecting the developed material to a desilverization treatment, where the desilverization treatment is carried out using a processing solution having a bleaching ability and containing at least one of an amidine compound or a bisguanidine compound and a ferric salt of an organic acid.

(2) In another embodiment, the present invention provides a method for forming an image in a silver halide photographic material comprising a support having thereon at least one light-sensitive silver halide emulsion layer which comprises image-wise exposing the silver halide photographic material, Color developing the exposed material and then subjecting the developed material to a desilverization treatment, wherein the desilverization treatment is carried out in the presence of a stilbene fluorescent brightener by using a desilverization bath having a bleaching ability and containing at least one of an amidine compound or a bisguanidine compound and ferric salt of an organic acid.

(3) In a further embodiment the invention provides a method for forming an image in a silver halide photographic material as described in the above embodiment (1) or (2), wherein the amidine compound or the bisguanidine compound is a compound represented by the following general formula (1).

$$B_nA \qquad (1)$$

where in general formula (1), n represents an integer of 1 to 4; when n=1, A represents a hydrogen atom or an amino group; and B represents a residue formed by removing one hydrogen atom from an amidine represented by the following general formula (2); when n≧2, A represents an n-valent organic residue having 10 carbon atoms or less; and B represents a residue formed by removing one hydrogen atom from an amidine or guanidine represented by the following general formula (2).

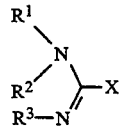

(2)

where in general formula (2), $R^1$, $R^2$ and $R^3$ may be the same or different and each represents a hydrogen atom or an alkyl group having not more than 6 carbon atoms; X represents a hydrogen atom, an amino group, an alkyl group, an aryl group or a heterocyclic group, and these substituent groups have 8 carbon atoms or less; or any two of $R_n^1$, $R_n^2$, $R_n^3$ and $X_n$ (wherein n is as defined above) may combine together to form a ring.

(4) In an even further embodiment, the invention provides a method for forming an image in a silver halide photographic material as described in any one of the preceding embodiment (1), (2) and (3), wherein the light-sensitive silver halide emulsion comprises silver halide grains having a silver chloride content of at least 90 mol %.

DETAILED DESCRIPTION OF THE INVENTION

The present invention is illustrated in greater detail below.

It has now been found that when compounds such as amidines or bisguanidines are used in the desilverization bath such as a bleaching bath or a bleaching-fixing bath in the processing of photographic materials, color developing agents and materials forming coloration such as dyes, etc. can be rapidly washed off. The present invention has been accomplished on the basis of this finding.

It is preferred for the above-described amidines and bisguanidines to characteristics such that conjugated acids have a high acid dissociation constant (pKa) as measured at 25° C. in an aqueous solution, particularly preferably a pKa of at least 11.0. The upper limit is about 14.

It is an unexpected finding that only these specific compounds can reduce the formation of stain after the processing of an image and after a lapse of time without deteriorating the stability of the image even when a short-time rinsing or stabilization subsequent to the desilverization bath is carried out. It has also been found that these compounds have scarcely a desilverization accelerating effect when the desilverization time is not longer than 20 seconds.

Further, it has been found that when the compounds such as the above-described amidines or bisguanidines are used in the processing solutions having a bleaching ability, the formation of stain after processing can be reduced, though stain is conventionally tends to be formed when rapid processing is carried out by a low replenishment rate, such as a replenishment rate of 30 to 120 ml/m$^2$.

It has also been found that when only the above-described amidines or bisguanidines are used in the processing solutions having a bleaching ability, a degree of accelerating the removal of sensitizing dyes is low, but the removal of the sensitizing dyes can be surprisingly accelerated in the presence of a stilbene fluorescent brightener in addition to the amidines or bisguanidines. The fluorescent brightener may be added to the desilverization bath. Alternatively, the light-sensitive material is soaked in the fluorescent brightener and then processed with a desilverization bath containing the amidines or bisguanidines. If desired, the fluorescent brightener may be previously present in the light-sensitive material. In any case, the removal of the sensitizing dyes can be sufficiently accelerated.

It has been found that these methods can solve the problem with regard to the deterioration of the white area of the image caused by stain formed by the color developing agents and the coloring materials such as sensitizing dyes and other dyes left behind in the ultra-high rapid processing with a low replenishment rate.

More specifically, in the present invention, the removal of color developing agents and dyes car be accelerated and a reduction in the deterioration of the white area of the image caused by stain formed by these color developing agents and dyes can be achieved by a method for processing a silver halide color photographic material comprising a support having thereon at least one light-sensitive silver halide emulsion layer, which comprises subjecting the silver halide color photographic material to an image-wise exposure, color development and then a desilverization treatment, where the desilverization treatment is carried out using a processing solution having a bleaching ability and containing at least one of an amidine compound or a bisguanidine compound and a ferric salt of an organic acid.

Further, in the present invention, the removal of sensitizing dyes together with other dyes can be accelerated and a reduction in the deterioration of the white area of the image caused by stain formed by the sensitizing dyes and other dyes can be achieved by a method for processing a silver halide photographic material comprising a support having thereon at least one light-sensitive silver halide emulsion layer, which comprises subjecting the silver halide photographic material to an image-wise exposure, development and then a desilverization treatment, where the desilverization treatment is carried out in the presence of a stilbene fluorescent brightener using a desilverization bath containing at least one amidine compound or a bisguanidine compound.

As mentioned above, it has been proposed that various compounds such as bleaching accelerators are added to the processing solution when silver halide color photographic materials are conventionally processed with the processing solution having a bleaching ability. However, only some of them have been examined.

It has been for the first time found that when processing is carried out with amidines or bisguanidines in the processing solution having a bleaching ability, there is the effect that color developing agents and coloring materials such as dyes and sensitizing dyes can be washed off well during processing.

Amidines or bisguanidines which can be used in the present invention are compounds of the general formula (1). These compounds are illustrated in greater detail hereinafter.

The present invention is achieved by a processing method wherein the processing time of the light-sensitive material is such that the desilverization time is 20 seconds or less, and a time taken until completion of the drying stage from the beginning of development is 120 seconds or less. The term "processing time" as used herein refers to the residence time of the light-sensitive material in the processing solution.

In the processing method of the present invention, the effect thereof can be fully obtained under low replenishment rate conditions. The replenishment rate of the developing solution and the bleaching-fixing solution or the fixing solution is preferably 120 ml per m$^2$ or less, more preferably 15 to 60 ml/m$^2$ or less. It is also a preferred embodiment that processing is carried out without any replenishment (no replenishment includes the case where the processing solution is simply replenished with the amount of water lost by evaporation).

Now, the present invention will be illustrated in still greater detail below.

Amidines or bisguanidines which are used in the present invention are preferably compounds represented by the following general formula (1). Other compounds than those of general formula (1) can also be used.

$$B_nA \qquad (1)$$

In general formula (1), n represents an integer of 1 to 4. When n=1, A represents a hydrogen atom or an amino group, and B is a residue formed by removing one hydrogen atom from an amidine represented by the general formula (2) below. When n≧2, A represents an n-valent organic residue having 10 carbon atoms or less, and B represents a residue formed by removing one hydrogen atom from an amidine or guanidine represented by the following general formula (2).

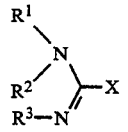

(2)

In general formula (2), $R^1$, $R^2$ and $R^3$ may be the same or different and each represents a hydrogen atom or an alkyl group 6 or less carbon atoms. It is preferred that not more than two of $R^1$, $R^2$ and $R^3$ are each an alkyl group. It is particularly preferred that not more than one thereof is an alkyl group. X represents a hydrogen atom, an amino group, an alkyl group, an aryl group or a heterocyclic group, and these substituent groups have 8 carbon atoms or less. Any two of the substituent groups $R^1_n$, $R^2_n$, $R^3_n$, and $X_n$ (wherein n is as defined above) may combine together to form a ring. The aryl group represented by X preferably has from 6 to 14 carbon atoms.

In general formula (1), when n=1 and A is an amino group, the amino group may be substituted. Examples of suitable amino groups include —$NH_2$, dimethylamino group, methylamino group, ethylamino group and guanidino group. When n≧2, examples of n-valent organic residues having 10 or less carbon atoms represented by A include an alkylene group (e.g., a methylene group, an ethylene group, —$CH_2$—CH(OH)—$CH_2$—), and an arylene group (e.g., a phenylene group, a naphthylene group, a xylylene group) and groups represented by the following formulas.

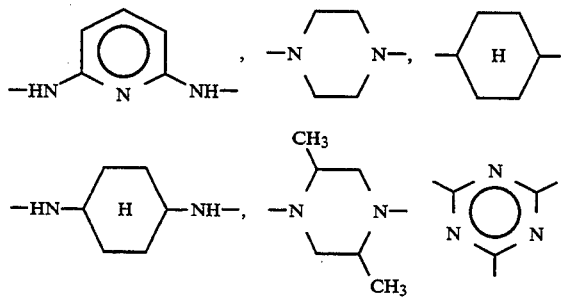

The alkyl group having 6 or less carbon atoms represented by $R^1$, $R^2$ and $R^3$ in general formula (2) is an alkyl group which may be substituted. Examples of the alkyl group include a methyl group, an ethyl group, an isopropyl group, a cyclohexyl group and a benzyl group. The amino group represented by X is an amino group which may be substituted. Examples of suitable amino groups include —$NH_2$, a methylamino group, a dimethylamino group, —$NHCH_2CH_2N(CH_3)_2$ and a phenylamino group. The alkyl group represented by X is an alkyl group which may be substituted. Examples of suitable alkyl groups include a methyl group, an ethyl group, a 2-methoxyethyl group, a benzyl group and a 2-hydroxypropyl group. The aryl group represented by X is an aryl group which may be substituted. Examples of suitable aryl groups include a phenyl group, a tolyl group, a xylyl group, a naphtyl group, a p-methoxyphenyl group and a m-hydroxyphenyl group. The heterocyclic group represented by X is a heterocyclic group which may be substituted. Examples of typical heterocyclic groups include a pyridyl group, a thienyl group and a 5-methylpyridyl group. Preferably, the heterocyclic group is a 5- or 6- membered ring. These substituent groups must have 8 carbon atoms or less.

Preferably not more than two (including zero) of $R^1$, $R^2$ and $R^3$ in general formula (2) are an alkyl group for the purpose of the present invention.

The amidines of the present invention can be easily synthesized using nitrile compounds as starting materials according to the methods described in *Organic Systems Collective*, Vol. 1, page 5 (John Wiley and Sons, Inc.) and JP-A-63-316760.

The bisguanidines can be synthesized by reference to the methods described in *Methoden der Organischen Chemie* (Houben-Weyl), Fourth Edition, Vol. 8, pp. 180–195 (1952) and ibid., Vol. E4, pp. 608–624 (1983).

Principal fundamental reactions in the above synthesis are as follows.

(1) Reaction of cyanamide with amine:

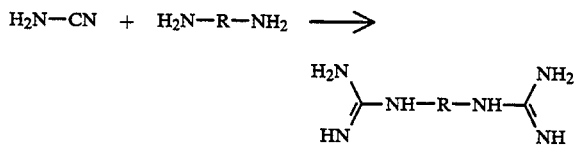

(2) Reaction of carbodiimide with amine:

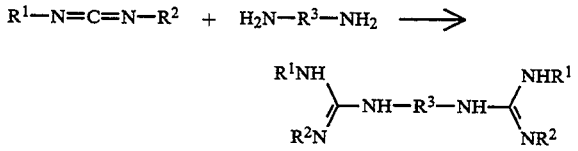

(3) Reaction of isothiourea with amine:

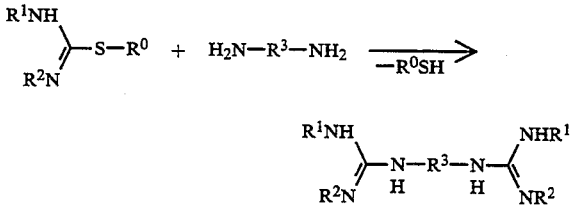

(4) Reaction of thiourea with amine:

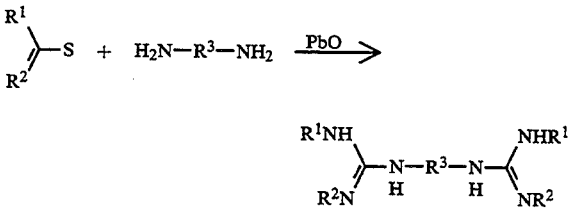

(5) Reaction of unsubstituted guanidine with amine:

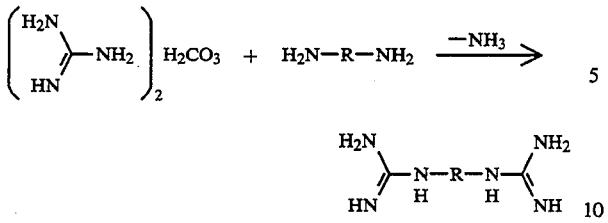
Examples of the amidine compounds and the bis-guanidine compounds which can be used in the present invention include the following compounds.
Examples of the compounds where n=1 are shown below.
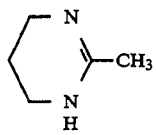
(AM-1)
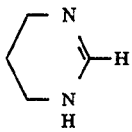
(AM-2)
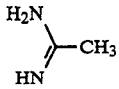
(AM-3)
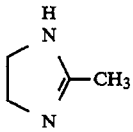
(AM-4)
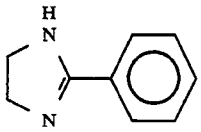
(AM-5)
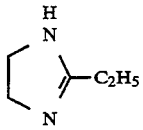
(AM-6)
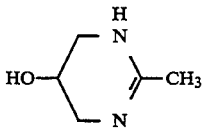
(AM-7)
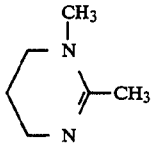
(AM-8)
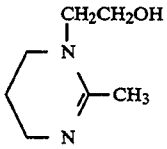
(AM-9)
-continued
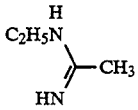
(AM-10)
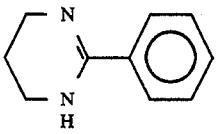
(AM-11)
Examples of bis-compounds are shown below.
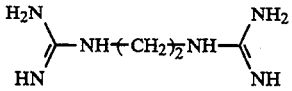
(B-1)
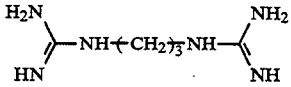
(B-2)
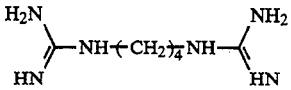
(B-3)
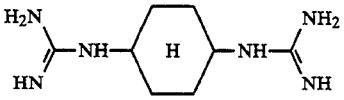
(B-4)
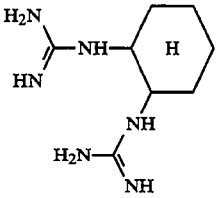
(B-5)
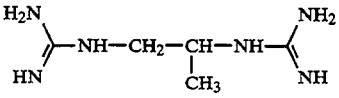
(B-6)
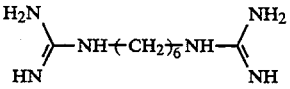
(B-7)
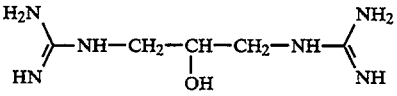
(B-8)
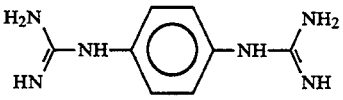
(B-9)
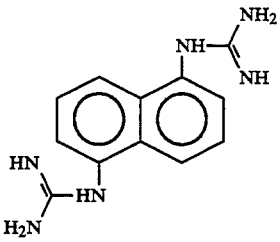
(B-10)

-continued
(B-11)
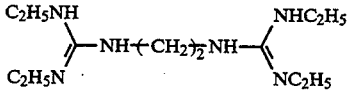
(B-12)
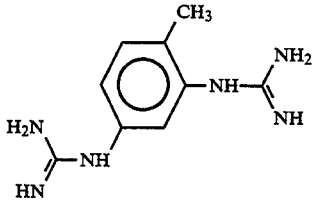
(B-13)
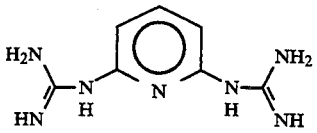
(B-14)
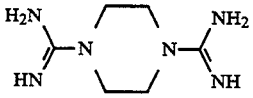
(B-15)
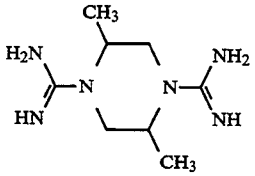
(B-16)
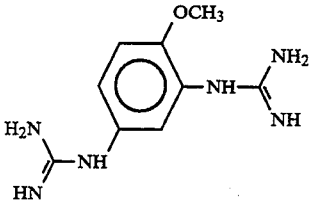
(B-17)
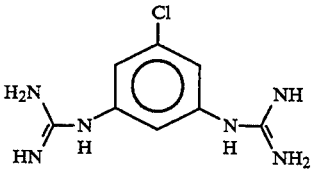
(B-18)
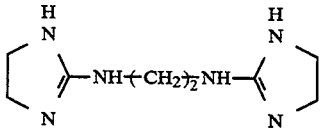
(B-19)
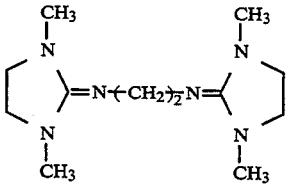
(B-20)
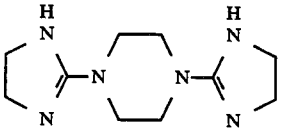
-continued
(B-21)
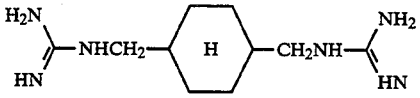
(B-22)
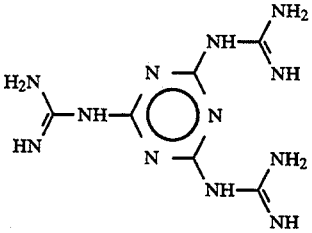
(B-23)
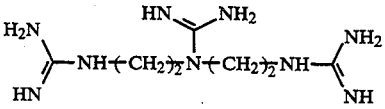
(B-24)
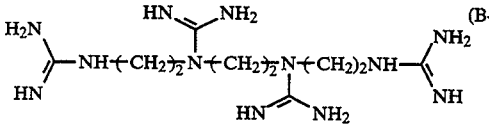
(BA-1)
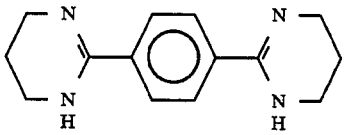
(BA-2)
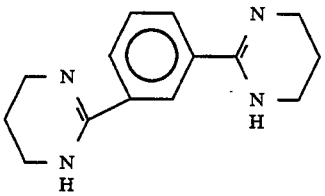
(BA-3)
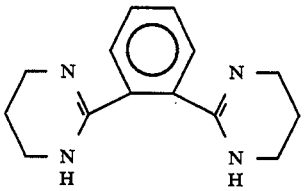
(BA-4)
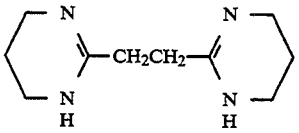
(BA-5)
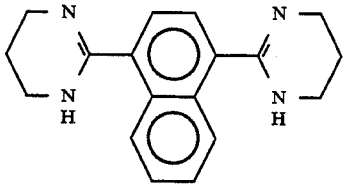
(BA-6)
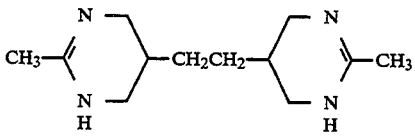

-continued
(BA-7)
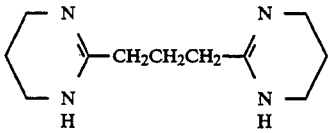
(BA-8)
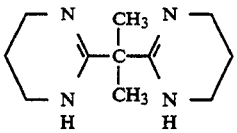
(BA-9)
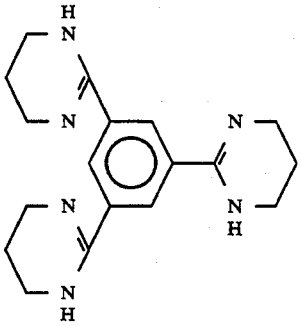
(BA-10)
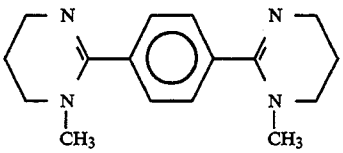
(BA-11)
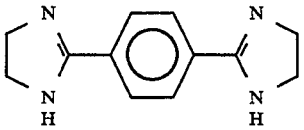
(BA-12)
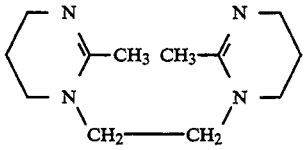
(BA-13)
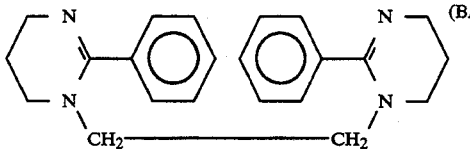
(BA-14)
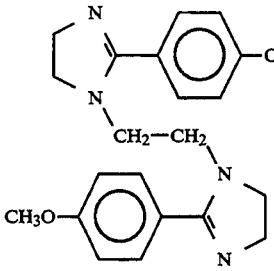
-continued
(BA-15)
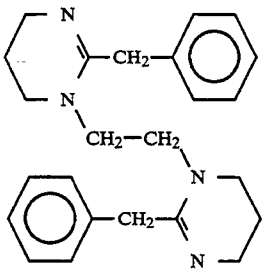
(BA-16)
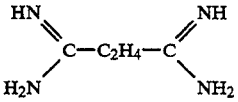
(BA-17)
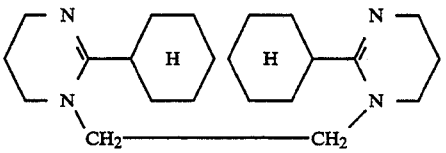
(BA-18)
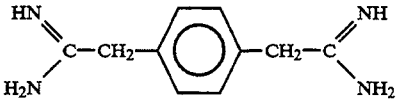
(BA-19)
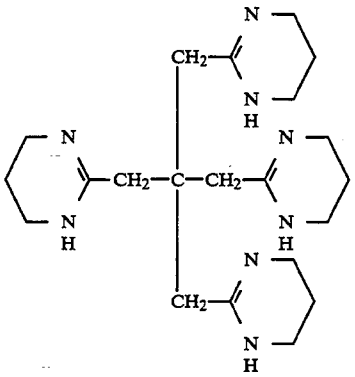
(BA-20)
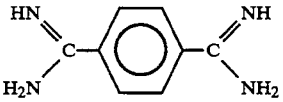
(BA-21)
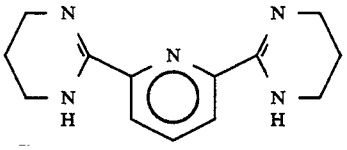
(BA-22)
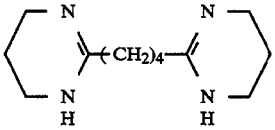
(BA-23)
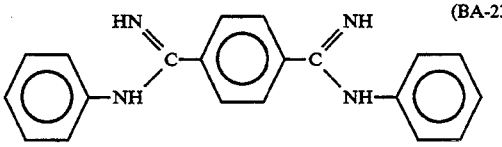

-continued

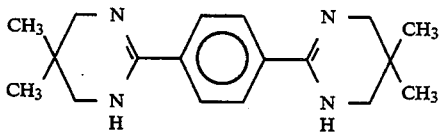

(BA-24)

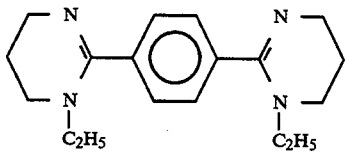

(BA-25)

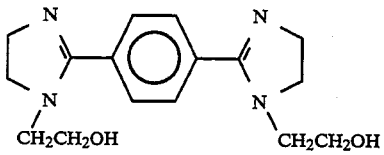

(BA-26)

(BA-27)

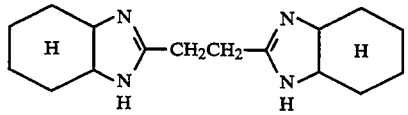

(BA-28)

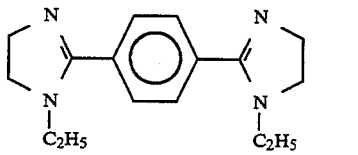

(BA-29)

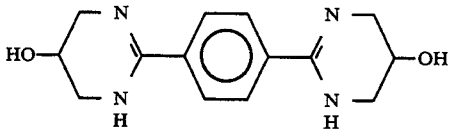

(BA-30)

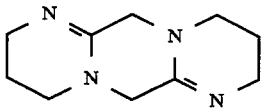

(BA-31)

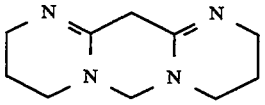

Of these examples, BA-1, BA-7, BA-9, BA-22, B-1, B-2, B-3, B-8, B-14 and B-18 are particularly preferred.

There is no particular limitation with regard to the amounts of these amidines or bisguanidines which can be present. These compounds may be used in an amount such that the effect thereof can be obtained. Generally, these compounds are present in the processing solution or the desilverization bath in an amount of preferably 0.001 to 1 mol/l, more preferably 0.01 to 0.2 mol/l, particularly preferably 0.02 to 0.1 mol/l.

With regard to the pH of each processing solution containing these compounds, the pH of the bleaching-fixing solution is in the range of preferably 4 to 7, more preferably 5 to 6, and the pH of the bleaching solution is in the range of preferably 2 to 7, more preferably 4 to 6. The pH of the fixing solution used in the fixing stage after the bleaching stage is in the range of preferably 4 to 7, more preferably 5 to 7.

Various stilbene fluorescent brighteners can be used as brighteners in the present invention. Of them, di(-triazilamino)-stilbene fluorescent brighteners are preferred. Brighteners represented by the following general formula (3) are particularly preferred.

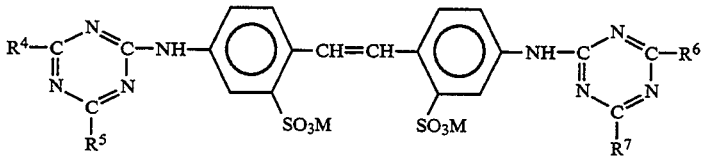

(3)

wherein $R^4$, $R^5$, $R^6$ and $R^7$ each represents a hydroxyl group, a halogen atom, a morpholino group, an alkyl group, an alkoxy group, an aryloxy group, an aryl group, an amino group, an alkylamino group or an arylamino group; and M represents a hydrogen atom, an alkali metal cation or a quaternary ammonium ion.

More specifically, examples of suitable halogen atoms include chlorine and bromine. Examples of typical alkyl groups include methyl, ethyl and propyl. Examples of appropriate alkoxy or aryloxy groups include phenoxy and p-sulfophenoxy. Examples of aryl groups include phenyl and methoxyphenyl. Examples of alkylamino groups include methylamino, ethylamino, propylamino, butylamino, dimethylamino, cyclohexylamino, β-hydroxyethylamino, di(β-hydroxyethyl)amino, β-sulfoethylamino, N-(β-sulfoethyl)-N'-methylamino and N-(β-hydroxyethyl)-N'-methylamino. Examples of arylamino groups include anilino, o-, m- or p-sulfoanilino, disulfoanilino, o-, p- or m-chloroanilino, o-, m- or p-toluidino, o-, m- or p-carboxyanilino, dicarboxyanilino, o-, m- or p-hydroxyanilino, sulfonaphthylamino, o-, m- or p-aminoanilino and o-, m- or p-anidino.

The alkyl group, alkoxy group, aryloxy group, aryl group, alkylamino group or arylamino group represented by $R^4$, $R^5$, $R^6$ and $R^7$ preferably has from 1 to 10 carbon atoms.

Examples of alkali metal cations as M include lithium, sodium and potassium. Examples of quaternary ammonium ions include ammonium, tetrabutyl ammonium and pyridinium.

Examples of the stilbene fluorescent brighteners which can be used in the present invention include, but are not limited to, the following compounds.

(F-1)
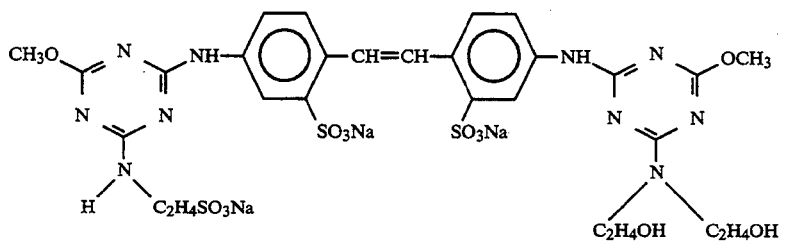
(F-2)
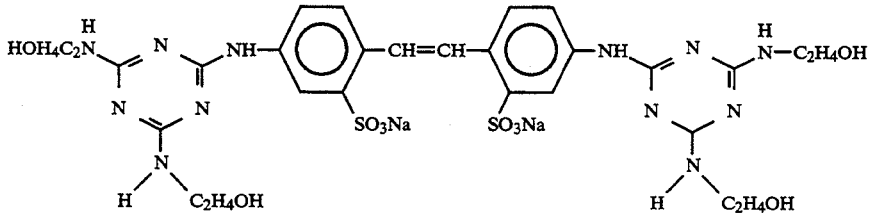
(F-3)
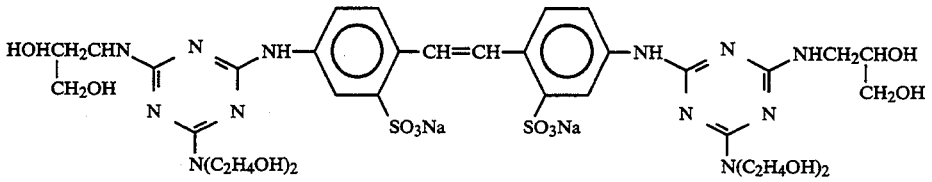
(F-4)
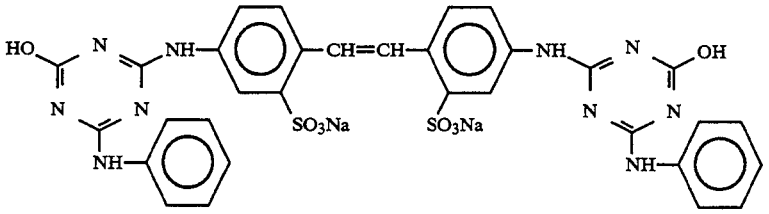
(F-5)
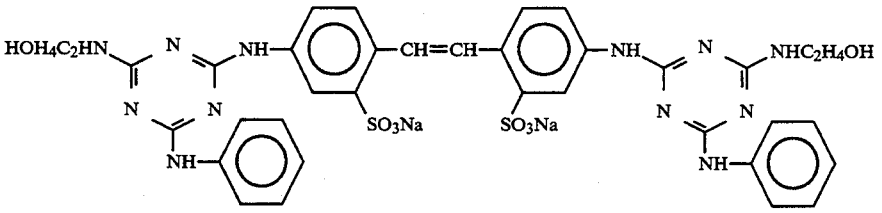
(F-6)
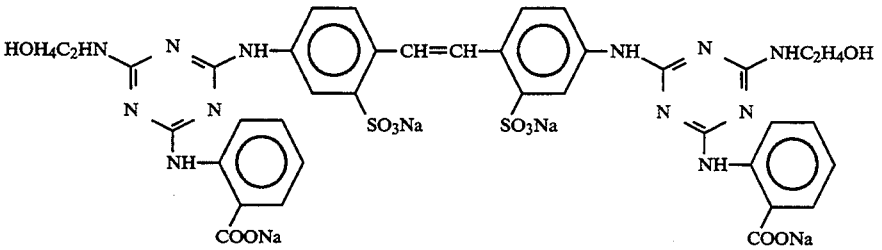
(F-7)
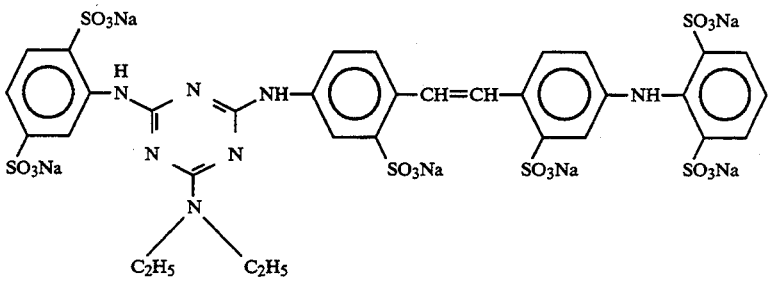

-continued
(F-8)
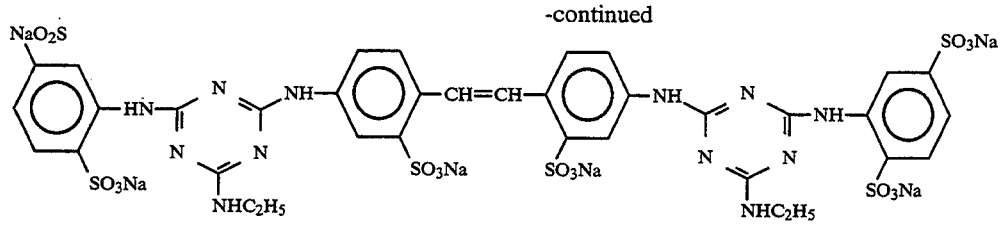
(F-9)
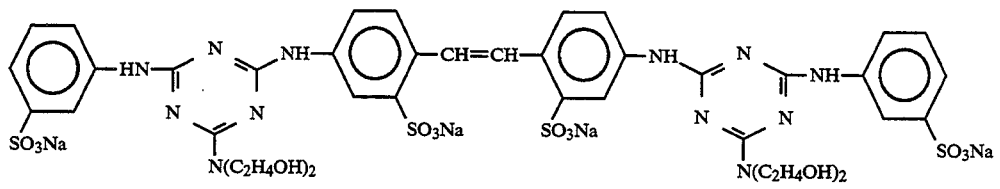
(F-10)
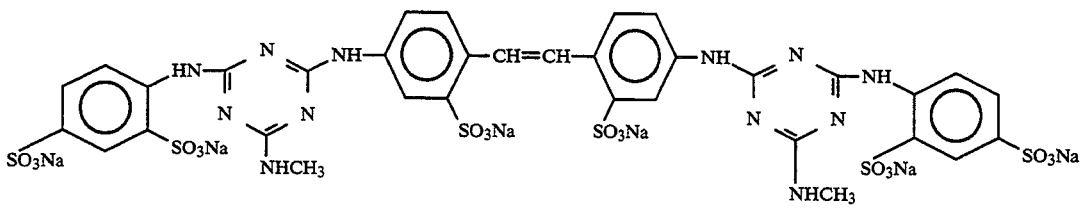
(F-11)
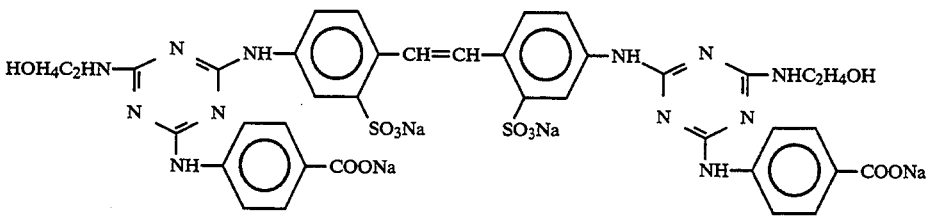
(F-12)
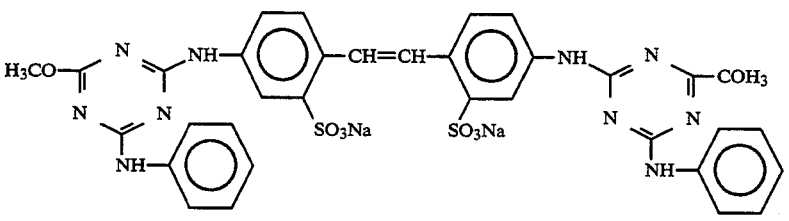
(F-13)
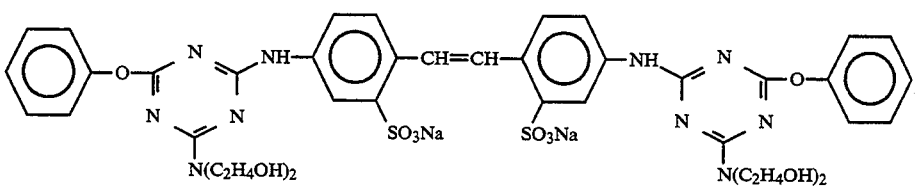
(F-14)
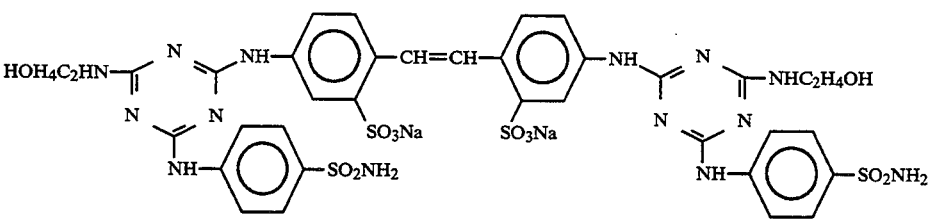
(F-15)
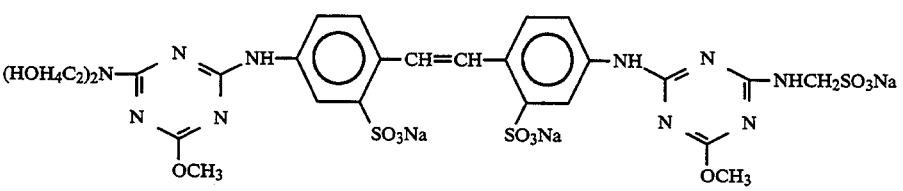

-continued (F-16)

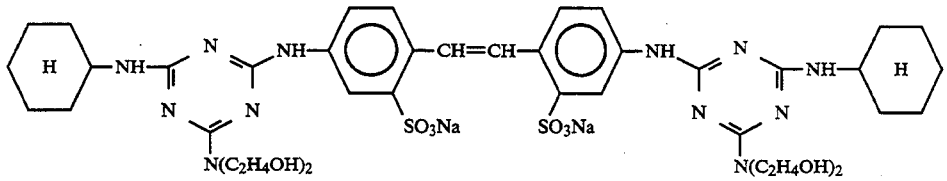

(F-17)

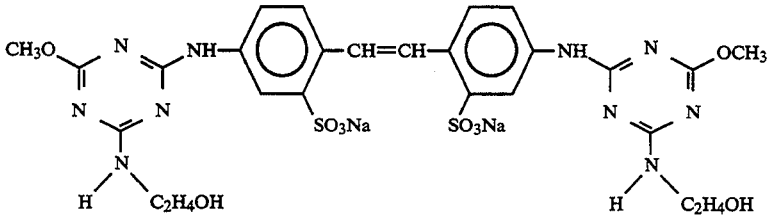

Of these examples, F-1, F-2 and F-3 are particularly preferred.

These compounds are known, and are commercially available or can be easily synthesized using known methods.

The amount of the stilbene fluorescent brightener present in the desilverization bath containing at least one of the above-described amidines or bisguanidines is preferably $1\times10^{-4}$ to $5\times10^{-2}$ mol/l, more preferably $2\times10^{-4}$ to $1\times10^{-2}$ mol/l. The brightener may be added to the desilverization bath so as to produce a bath containing the brightener in the amount described above. Alternatively, the brightener may be previously present in the light-sensitive material so as to provide the brightener in an amount described above in the bath.

The color photographic materials of the present invention include color photographic papers which generally comprises a support having thereon at least one blue-sensitive silver halide emulsion layer, at least one green-sensitive silver halide emulsion layer and at least one red-sensitive silver halide emulsion layer. In general-purpose color photographic papers, the emulsion layers are coated on the support in order described above. However, the emulsion layers may be arranged in a different order from that described above.

Image forming system including the light-sensitive materials and processing of the present invention can be applied to rapid processing conventionally used for color prints. Further, the system can be applied to intelligent color hard copy which requires much more rapid processing.

In a preferred embodiment of intelligent color hard copy, scanning exposure is conducted by using high-density beams such as those from a laser (e.g., a semiconductor laser) or a light-emitting diode.

Many semiconductor laser beams comprise light in the infrared region. Hence, an infrared-sensitive silver halide emulsion layer can be used in place of at least one of the emulsion layers of the light-sensitive material. Color reproduction by subtractive color photography can be achieved with dyes of complementary color relationship to light to which the silver halide emulsions are sensitive, that is, color couplers (yellow coupler sensitive to blue light, magenta coupler sensitive to green light and cyan coupler sensitive to red light) in these light-sensitive emulsion layers. The light-sensitive layers may not correspond to the hue of developed color as described above.

Color couplers may be two colors depending on image or quality required. Silver halide emulsion layers may comprise two layers corresponding to two colors. In this case, a full color image is not formed. However, an image can be formed much more rapidly.

The silver halide present in the silver halide emulsions of the present invention is silver chloride or silver chlorobromide having a silver chloride content of not lower than 90 mol %. With regard to the halogen compositions of the silver halide grains, the grains may have the same halogen composition or different halogen compositions. However, when grains having the same halogen composition are used, the properties of the grains easily can be made homogeneous. With regard to the halogen composition distribution of the silver halide grains, grains can be appropriately chosen from uniform structure type grains wherein the halogen composition is uniform throughout the grain; integral layer structure type grains wherein a core in the interior of the silver halide grain has a different halogen composition from a shell (composed of a single layer or two or more layers) which surrounds the core; and grains having a structure such that an area having a different halogen composition is present in a non-laminar form in the interior or on the surface of the grain (when the area having a different halogen composition is present on the surface of the grain, the grain has a structure such that the area having a different halogen composition is joined to the edge, corner or plane of the grain). The latter two types are preferable to uniform structure type grains to obtain high sensitivity. The latter two types are also preferred from the viewpoint of pressure resistance. When the silver halide grains have the above-described structures, the boundary between the areas with different halogen compositions may be a definite one, or an indefinite one where a mixed crystal is formed by the difference in the halogen composition. The boundary also may be one where the structure is continuously changed.

It is preferred that uniform structure type grains having a narrow halogen composition distribution are used in high silver chloride emulsions having a silver chloride content of 90 mol % or more to prevent as much as possible the sensitivity from being lowered when pressure is applied to the light-sensitive materials.

It is also effective for the silver chloride content of the silver halide emulsion to be further increased to reduce the replenishment rate of the processing solution. In this case, an emulsion comprising grains with a silver chloride content of 98 to 100 mol %, that is, nearly pure silver chloride grains can be advantageously used.

Silver halide emulsions which can be advantageously used in the present invention include those described in Japanese Patent Application Nos. 3-255889.

It is preferred for dyes decolorized by processing (particularly oxonol dyes) as described in EP 0 377 490 A2 (pages 27 to 76) to be present in the hydrophilic colloid layers of the light-sensitive materials of the present invention in an amount to provide an optical reflection density of at least 0.70 at 680 nm, or at least 12 wt % (more preferably at least 14 wt %) of titanium oxide having a surface treated with a dihydric to tetrahydric alcohol (e.g., trimethylol ethane) is present in a water-resistant resin layer of the support to improve image sharpness.

It is preferred that the light-sensitive materials of the present invention contain dye image preservability improving compounds, e.g., as described in EP 0 277 589 A2 together with couplers, particularly pyrazoloazole couplers.

Namely, a compound (F) represented by formula (I) or (II) and/or a compound (G) represented by formula (III) disclosed in JP-A-3-22946 (pages 17–28) are/is used, the compound (F) being chemically bonded to aromatic amine developing agents left behind after color development to form a compound which is chemically inert and substantially colorless, and the compound (G) being chemically bonded to the oxidation product of aromatic amine color developing agents to form a compound which is chemically inert and substantially colorless. For example, the use of these compounds is preferred from the viewpoint of preventing stain from being formed by developed dyes produced by the reaction of the couplers with the color developing agents or the oxidation product thereof left behind in the layers during storage after processing and preventing other side effects from occurring.

It is preferred for the light-sensitive materials of the present invention to contain antifungal agents described in JP-A-63-271247 to prevent the images from being deteriorated by growth of mold and bacteria in the hydrophilic colloid layers thereof.

Supports which can be used for the light-sensitive materials of the present invention include white polyester supports for display and supports wherein a white pigment-containing layer is provided on the silver halide emulsion layer side thereof. It is preferred for an antihalation layer to be coated on the silver halide emulsion layer-coated side of the support or on the back side thereof in order to improve sharpness. It is also preferred for the transmission density of the support to be set to a value of 0.35 to 0.8 in order to permit display to be enjoyed by reflected light as well as transmitted light.

The light-sensitive materials of the present invention may be exposed to visible light or infrared light. Exposure may be using any of low-illumination exposure and high-illumination exposure. In the latter case, a laser scanning exposure system wherein exposure time is shorter than $10^{-4}$ seconds per pixel is preferred.

Further, it is preferred for a band stop filter described in U.S. Pat. No. 4,880,726 to be used when exposure is conducted. When such a filter is used, color mixing of light is removed and color reproducibility can be greatly improved.

The exposed light-sensitive materials may be subjected to color development. It is preferred from the standpoint of rapid processing that the light-sensitive materials are subjected to bleaching-fixing after color development. Particularly when the above-described high silver chloride emulsions are used, the pH of the bleaching-fixing solution is preferably 6.5 or lower, more preferably about 6 or lower from the standpoint of accelerating desilverization. There is no particular limitation with regard to the lower limit on the pH. However, a pH of 4 or higher is preferred.

Silver halide emulsions, other materials (e.g., additives), photographic layers (e.g., layer arrangement), processing methods and processing additives described in the following patent specifications, particularly EP 0 355 660 A2 (JP-A-2-139544) can be preferably applied to the light-sensitive materials of the present invention.

| Photographic Element, etc. | JP-A-62-215272 | JP-A-2-33144 | EP0 355 660 A2 |
|---|---|---|---|
| Silver Halide Emulsions | The 6th line of right upper column of page 10 to the 5th line of left lower column of page 12; and the 4th line from the bottom of right lower column of page 12 to the 17th line of left upper column of page 13 | The 16th line of right upper column of page 28 to the 11th line of right lower column of page 29; and the 2nd line to the 5th line of page 30 | The 53th line of page 45 to the 3rd line of page 47; and the 20th line to the 22nd line of page 47 |
| Solvents for Silver Halide | The 6th line to the 14th line of left lower column of page 12; and the third line from the bottom of left upper column of page 13 to the bottom of left lower column of page 18 | — | — |
| Chemical Sensitizing Agents | The 3rd line from the bottom of left lower column to the 5th line from the bottom of right lower column of page 12; and the first line of right lower column of page 18 to the 9th line from the bottom of right upper column of page 22 | The 12th line to the bottom of right lower column of page 29 | The 4th line to the 9th line of page 47 |

-continued

| Photographic Element, etc. | JP-A-62-215272 | JP-A-2-33144 | EP0 355 660 A2 |
|---|---|---|---|
| Spectral Sensitizing Agents (spectral sensitization methods) | The 8th line from the bottom of right upper column of page 22 to the bottom of page 38 | The first line to the 13th line of left upper column of page 30 | The 10th line to the 15th line of page 47 |
| Emulsion Stabilizer | The 1st line of left upper column of page 39 to the bottom of right upper column of page 39 | The 14th line of left upper column of page 30 to the first line of right upper column of page 30 | The 16th line to the 19th line of page 47 |
| Development Accelerators | The 1st line of left lower column of page 72 to the 3rd line of right upper column of page 91 | — | — |
| Color Couplers (cyan, magenta and yellow couplers) | The 4th line of right upper column of page 91 to the 6th line of left upper column of page 121 | The 14th line of right upper column of page 3 to the bottom of left upper column of page 18; and the 6th line of right upper column of page 30 to the 11th line of right lower column of page 35 | The 15th line to the 27th line of page 4; the 30th line of page 5 to the bottom of page 28; the 29th line to the 31st line of page 45; and the 23rd-line of page 47 to the 50th line of page 63 |
| Supersensitizing Agents | The 7th line of left upper column of page 121 to the first line of right upper column of page 125 | — | — |
| Ultraviolet Light Absorbers | The 2nd line of right upper column of page 125 to the bottom of left lower column of page 127 | The 14th line of right lower column of page 37 to the 11th line of left upper column of page 38 | The 22nd line to the 31st line of page 65 |
| Anti-Fading Agents (image stabilizer) | The 1st line of right lower column of page 127 to the 8th line of left lower column of page 137 | The 12th line of right upper column of page 36 to the 19th line of left upper column of page 37 | The 30th line of page 4 to the 23rd line of page 5; the 1st line of page 29 to the 25th line of page 45; the 33rd line to the 40th line of page 45; and the 2nd line to the 21st line of page 65 |
| High-Boiling and/or Low-Boiling Organic Solvents | The 9th line of left lower column of page 137 to the bottom of right upper column of page 144 | The 14th line of right lower column of page 35 to the 4th line from the bottom of left upper column of page 36 | The 1st line to the 51st line of page 64 |
| Dispersion Methods for Photographic Additive | The 1st line of left lower column of page 144 to the 7th line of right upper column of page 146 | The 10th line of right lower column of page 27 to the bottom of left upper column of page 28; and the 12th line of right lower column of page 35 to the 7th line of right upper column of page 36 | The 51st line of page 63 to the 56th line of page 64 |
| Hardening Agents | The 8th line of right upper column of page 146 to the 4th line of left lower column of page 155 | — | — |
| Developing Agent Precursors | The 5th line of left lower column of page 155 to the 2nd line of right lower column of page 155 | — | — |
| Restrainer Releasing Compounds | The 3rd line to the 9th line of right lower column of page 155 | — | — |
| Supports | The 19th line of right lower column of page 155 to the 14th line of left upper column of page 156 | The 18th line of right upper column of page 38 to the 3rd line of left upper column of page 39 | The 29th line of page 66 to the 13th line of page 67 |
| Layer Structures | The 15th line of left upper column of page 156 to the 14th line of right lower column of page 156 | The 1st line to the 15th line of right upper column of page 28 | The 41st line to the 52nd line of page 45 |
| Dyes | The 15th line of right lower column of page 156 to the bottom of right lower column of page 184 | The 12th line of left upper column of page 38 to the 7th line of right upper column of page 38 | The 18th line to the 22nd line of page 66 |
| Color Mixing Inhibitors | The 1st line of left upper column of page 185 to the 3rd line of right lower column of page 188 | The 8th line to the 11th line of right upper column of page 36 | The 57th line of page 64 to the 1st line of page 65 |
| Gradation Controllers | The 4th line to the 8th line of right lower | — | — |

-continued

| Photographic Element, etc. | JP-A-62-215272 | JP-A-2-33144 | EP0 355 660 A2 |
|---|---|---|---|
| | column of page 188 | | |
| Stain Inhibitor | The 9th line of right lower column of page 188 to the 10th line of right lower column of page 193 | The bottom of left upper column of page 37 to the 13th line of right lower column of page 37 | The 32th line of page 65 to the 17th line of page 66 |
| Surfactants | The 1st line of left lower column of page 201 to the bottom of right upper column of page 210 | The 1st line of right upper column of page 18 to the bottom of right lower column of page 24; and the 10th line from the bottom of left lower column of page 27 to the 9th line of right lower column of page 27 | — |
| Fluorine-Containing Compounds (antistatic agent, coating aid, lubricant, anti-sticking agent, etc.) | The 1st line of left lower column of page 210 to the 5th line of left lower column of page 222 | The 1st line of left upper column of page 25 to the 9th line of right lower column of page 27 | — |
| Binder (hydrophilic colloid) | The 6th line of left lower column of page 222 to the bottom of left upper column of page 225 | The 8th line to the 18th line line of right upper column of page 38 | The 23rd line to the 28th line of page 66 |
| Thickener | The 1st line of right upper column of page 225 to the 2nd line of right upper column of page 227 | — | — |
| Antistatic Agent | The 3rd line of right upper column of page 227 to the 1st line of left upper column of page 230 | — | — |
| Polymer Latexes | The 2nd line of left upper column of page 230 to the bottom of page 239 | — | — |
| Matting Agents | The 1st line of left upper column of page 240 to the bottom of right upper column of page 240 | — | — |
| Photographic Processing Methods (processing stage, additive, etc.) | The 7th line of right upper column of page 3 to the 5th line of right upper column of page 10 | The 4th line of left upper column of page 39 to the bottom of left upper column of page 42 | The 14th line of page 67 to the 28th line of page 69 |

Note
The cites to JP-A-62-215272 include an amendment dated March 16, 1987 and attached to the end of the JP-A publication.
Of the above color couplers, short wave type yellow couplers described in JP-A-63-231451, JP-A-63-123047, JP-A-63-241547, JP-A-1-173499, JP-A-1-213648, and JP-A-1-250944 are preferred as yellow couplers.

It is also preferred that 3-hydroxypyridine type cyan couplers [particularly, two equivalent type couplers formed by introducing a chlorine-eliminable group into a four equivalent type coupler of coupler (42), and couplers (6) and (9)] described in EP 0 333 185 A2 and cyclic active methylene type cyan couplers (particularly Couplers 3, 8, 34) described in JP-A-64-32260 in addition to diphenylimidazole type cyan couplers described in JP-A-2-33144 are used as cyan couplers.

It is preferred that the color photographic materials of the present invention are subjected to color development, bleaching-fixing and rinsing or stabilization. Bleaching and fixing may be carried out not only by a monobath as described above, but also by separate baths.

Typical examples of color developing agents which can be used in the present invention include, but are not limited to, the following compounds.

D-1 N,N-Diethyl-p-phenylenediamine
D-2 4-Amino-N,N-diethyl-3-methylaniline
D-3 4-Amino-N-(β-hydroxyethyl)-N-methylaniline
D-4 4-Amino-N-ethyl-N-(β-hydroxyethyl)aniline
D-5 4-Amino-N-ethyl-N-(β-hydroxyethyl)-3-methylaniline
D-6 4-Amino-N-ethyl-N-(3-hydroxypropyl)-3-methylaniline
D-7 4-Amino-N-ethyl-N-(4-hydroxybutyl)-3-methylaniline
D-8 4-Amino-N-ethyl-N-(β-methanesulfonamidoethyl)-3-methylaniline
D-9 4-Amino-N,N-diethyl-3-(β-hydroxyethyl)aniline
D-10 4-Amino-N-ethyl-N-(β-methoxyethyl)-3-methylaniline
D-11 4-Amino-N-(β-ethoxyethyl)-N-ethyl-3-methylaniline
D-12 4-Amino-N-(3-carbamoylpropyl)-N-n-propyl-3-methyl-aniline
D-13 4-Amino-N-(4-carbamoylbutyl)-N-n-propyl-3-methyl-aniline
D-14 N-(4-Amino-3-methylphenyl)-3-hydroxypyrrolidine
D-15 N-(4-Amino-3-methylphenyl)-3-(hydroxymethyl)-pyrrolidine
D-16 N-(4-Amino-3-methylphenyl)-3-pyrrolidinecarboxamide Of the above phenylenediamine derivatives, Compounds D-6, D-7, D-8 and D-12 are preferred with Compound D-8 being particularly preferred.

These p-phenylenediamine derivatives may be in the form of a salt such as the sulfate hydrochloride, sulfite, naphthalenedisulfonate or p-toluenesulfonate salt. The aromatic primary amine developing agents of the present invention are used in an amount of preferably 0.002 to 0.2 mol, more preferably 0.005 to 0.1 mol per liter of the developing solution (as tank solution).

In the practice of the present invention, use of developing solutions containing substantially no benzyl alcohol are preferred. The term "containing substantially no benzyl alcohol" as used herein means that the concentration of benzyl alcohol is preferably not higher than 2 ml/l, more preferably not higher than 0.5 ml/l. Most preferably, the developing solution is completely free from benzyl alcohol.

It is preferred for the developing solutions of the present invention or the replenishers therefor to contain substantially no sulfite ion. The sulfite ion functions as a preservative for the developing agents and at the same time, the sulfite ion has the capability of dissolving silver halide and the capability of reacting with the oxidation product of the developing agents to thereby lower the dye forming efficiency. It is believed that these effects cause an increase in the fluctuation in photographic characteristics on conducting continuous processing. The term "containing substantially no sulfite ion" as used herein means that the concentration of sulfite ion is preferably not higher than 10 ml per mol of the developing agent. It is most preferred for the developing solutions or the replenishers to be completely free from sulfite ion. A very small amount of sulfite ion can be present in a kit containing concentrated developing agent before the preparation of a working solution and such is used to prevent oxidation of the developing agent. Such a very small amount of sulfite ion as described above is excluded from the above-mentioned amount of sulfite ion present in the developing solutions or the replenishers.

It is preferred for the developing solutions of the present invention to contain substantially no sulfite ion as discussed above. It is more preferred for the developing solutions of the present invention to be substantially free from hydroxylamine. This is because it is believed that although hydroxylamine functions as a preservative for developing solutions, hydroxylamine itself has silver development activity, and hence the photographic characteristics are greatly affected by variation in the concentration of hydroxylamine. The term "substantially free from hydroxylamine" as used herein means that the concentration of hydroxylamine is preferably $5.0\times10^{-3}$ mol/l or less. It is most preferred for the developing solutions to be completely free from hydroxylamine.

It is preferred for the color developing solutions of the present invention and the replenishers therefor to contain organic preservatives rather than hydroxylamine and sulfite ion.

The term "organic preservative" as used herein refers all organic compounds capable of reducing the deterioration rate of aromatic primary amine color developing agents when present in processing solutions for the color photographic materials. More specifically, typical organic compounds are those having the capability of preventing oxidation of color developing agents by air, etc. Examples of particularly effective organic preservatives include hydroxylamine derivatives (excluding hydroxylamine; the same hereinafter), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamides and fused ring amines. These compounds are described in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-30496 (the term "JP-B" as used herein means an "examined Japanese patent publication").

Examples of other preservatives which may be optionally used include metals described in JP-A-57-44148 and JP-A-57-53749; salicylic acids described in JP-A-59-180588; alkanolamines described in JP-A-54-3532; polyethyleneimines described in JP-A-56-94349; and polyhydroxy compounds described in U.S. Pat. No. 3,746,544. Particularly preferred are alkanolamines such as triethanolamine, dialkylhydroxylamines such as diethylhydroxylamine, hydrazine derivatives and aromatic polyhydroxy compounds.

Of the above-described organic preservatives, hydroxylamine derivatives and hydrazine derivatives (hydrazines and hydrazides) are particularly preferred. The details thereof are described in JP-A-1-97953, JP-A-1-186939, JP-A-1-186940 and JP-A-1-187557.

It is preferred from the standpoint of improving the stability of color developing solutions and, in turn, stability during continuous processing that the hydroxylamine derivatives or the hydrazine derivatives are used in combination with the amines.

Examples of suitable amines include cyclic amines described in JP-A-63-239447, amines described in JP-A-63-128340 and amines described in JP-A-1-186939 and JP-A-1-187557.

Compounds represented by the following general formula (IV) can be advantageously used as the hydroxylamine derivatives in the present invention.

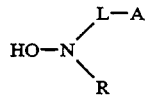

(IV)

wherein L represents an alkylene group which may be substituted; A represents a carboxyl group, a sulfo group, a phosphono group, a phosphino group, a hydroxyl group, an amino group which may be optionally alkyl-substituted, an ammonio group which may be optionally alkyl-substituted, a carbamoyl group which may be optionally alkyl-substituted, a sulfamoyl group which may be optionally alkyl-substituted or an alkylsulfonyl group which may be substituted; and R represents a hydrogen atom or an alkyl group which may be substituted.

Examples of suitable hydroxylamine derivatives which can be used in the present invention include, but are not limited to, the following compounds.

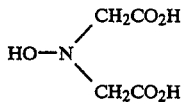

(IV-1)

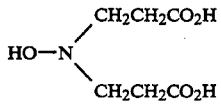

(IV-2)

-continued

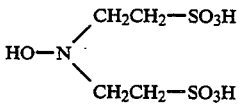
(IV-3)

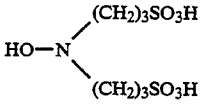
(IV-4)

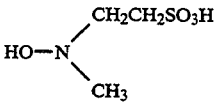
(IV-5)

Examples of sulfinic acids and salts thereof which can be used in the present invention include the following compounds.

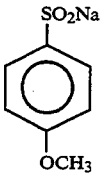
(S-1)

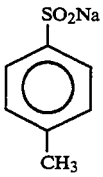
(S-2)

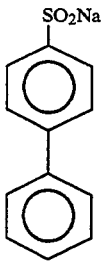
(S-3)

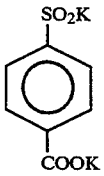
(S-4)

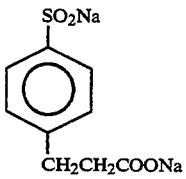
(S-5)

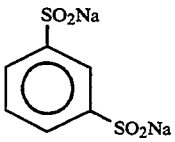
(S-6)

The above compounds may be used either alone or as a mixture of two or more of them.

The sulfinic acids can be synthesized using the method described in JP-A-62-143048 or by reference to this method.

The sulfinic acids are used in the color developing solutions of the present invention in an amount of 0.001 to 1.0 mol/l, preferably 0.002 to 0.2 mol/l.

It is preferred for the color developing solutions of the present invention to contain chloride ion in an amount of $3.5\times10^{-3}$ to $3.0\times10^{-1}$ mol/l, particularly preferably $1\times10^{-2}$ to $2\times10^{-1}$ mol/l. When the concentration of chloride ion is higher than $3.0\times10^{-1}$ mol/l, there is the disadvantage that development is retarded, and hence rapid processing and high maximum density which are intended by the present invention can not be achieved, while when the concentration of chloride ion is lower than $3.5\times10^{-3}$ mol/l, this low concentration is not preferred from the standpoint of preventing fogging.

It is preferred for the color developing solutions of the present invention to contain bromide ion in an amount of $0.5\times10^{-5}$ to $1.0\times10^{-3}$ mol/l, more preferably $3.0\times10^{-5}$ to $5\times10^{-4}$ mol/l. When the concentration of bromide ion is higher than $1\times10^{-3}$ mol/l, development is retarded, and maximum density and sensitivity are reduced, while when the concentration is lower than $0.5\times10^{-5}$ mol/l, fogging can not be sufficiently prevented.

Chloride ion and bromide ion may be directly added to the developing solutions, or it may be provided by dissolution out from the light-sensitive materials into the developing solutions during development.

When chloride ion is directly added to the color developing solutions, examples of chloride ion supply materials include sodium chloride, potassium chloride, ammonium chloride, lithium chloride, nickel chloride, magnesium chloride, manganese chloride, calcium chloride and cadmium chloride. Of these, sodium chloride and potassium chloride are preferred.

These ions may be provided by a fluorescent brightener present in the developing solutions.

Examples of bromide ion supply materials include sodium bromide, potassium bromide, ammonium bromide, lithium bromide, calcium bromide, magnesium bromide, manganese bromide, nickel bromide, cadmium bromide, cerium bromide and thallium bromide. Of them, potassium bromide and sodium bromide are preferred.

When chloride ion and bromide ion are to be dissolved out from the light-sensitive materials during development, these ions may be come from emulsions or from other sources.

The color developing solutions of the present invention have a pH of preferably 9 to 12, more preferably 9 to 11.0. The color developing solutions may contain other compounds which are conventionally present as components of the developing solutions.

It is preferred for buffering agents to be present to maintain the pH in the range described above. Examples of suitable buffering agents include carbonates, phosphates, borates, tetraborates, hydroxybenzoates, salts of glycine, salts of N,N-dimethylglycine, salts of leucine, salts of norleucine, salts of guanine, salts of 3,4-dihydroxyphenylalanine, salts of alanine, aminobutyrates, salts of 2-amino-2-methyl-1,3-propanediol, salts of valine, salts of proline, salts of trishydroxyaminomethane and salts of lysine. Particularly, carbonates, phosphates, tetraborates and hydroxybenzoates have advantages in that they have excellent solubility and buffer capacity in the high pH region of 9.0 or higher and do not have any adverse effect on photographic performance (e.g., fogging does not occur) when added to the color developing solutions. In addition, they are inexpensive. Accordingly, it is particularly preferred for these compounds to be used as the buffering agents.

Specific examples of suitable buffering agents include, but are not limited to, sodium carbonate, potassium carbonate, sodium bicarbonate, potassium bicarbonate, sodium phosphate, potassium phosphate, disodium hydrogen phosphate, dipotassium hydrogen phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The buffering agents are used in an amount of preferably at least 0.1 mol, particularly preferably 0.1 to 0.4 mol, per liter of the color developing solution or the replenisher therefor.

Further, the color developing solutions may contain various chelating agents as solubilizing agents for magnesium and calcium or to improve the stability of the color developing solutions. Examples of appropriate chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropane-tetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)-ethylenediamine-N,N'-diacetic acid and 1,2-hydroxybenzene-4,6-disulfonic acid.

These chelating agents may be used alone or as a combination of two or more of them if desired.

These chelating agents may be used in an amount sufficient to sequester metal ions in the color developing solutions. The chelating agents are generally used in an amount of 0.1 to 10 g/l.

The color developing solutions may optionally contain development accelerators if desired.

Examples of the development accelerators include thioether compounds described in JP-B-37-16088, JP-B-37-5987, JP-B-38-7826, JP-B-44-12380, JP-B-45-9019 and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796 and 3,253,919, JP-B-41-11431 and U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883 and U.S. Pat. No. 3,532,501; 1-phenyl-3-pyrazolidones, imidazoles and ascorbic acid.

Anti-fogging agents may be added to replenishers. Examples of the anti-fogging agents include alkali metal halides such as sodium chloride, potassium bromide and potassium iodide and organic anti-fogging agents. Typical examples of the organic anti-fogging agents include nitrogen-containing heterocyclic compounds such as benztriazole, 6-nitrobenzimidazole, 5-nitroisoindazole, 5-methylbenztriazole, 5-nitrobenztriazole, 5-chlorobenztriazole, 2-thiazolylbenzimidazole, 2-thiazolylmethyl-benzimidazole, indazole, hydroxyazaindolizine and adenine.

It is preferred for the color developing solutions to contain fluorescent brighteners. Preferred examples of fluorescent brighteners include 4,4'-diamino-2,2'-disulfostilbene compounds. The fluorescent brighteners are used in an amount of 0 to 5 g/l, preferably 0.1 to 4 g/l.

If desired, conventional water-soluble polymers such as polyvinyl alcohol, polyacrylic acid, polystyrenesulfonic acid, polyacrylamide, polyvinyl pyrrolidone and copolymers thereof and surfactants such as alkylsulfonic acids, arylsulfonic acids, aliphatic carboxylic acids, aromatic carboxylic acids and polyethylene oxide can be present.

The processing temperature of the color developing solutions of the present invention is 20° to 50° C., preferably 30° to 45° C.. The processing time is 5 to 240 seconds, preferably 10 to 60 seconds.

The color development solutions of the present invention exhibit relatively excellent performance with any solution opening ratio [contact area ($cm^2$) of solution with air/volume ($cm^3$) of solution] in comparison with any of conventional combinations. However, it is preferred from the standpoint of the stability of the color developing solutions for the opening ratio to be practically in the range of preferably 0.001 to 0.05 $cm^{-1}$, more preferably 0.002 to 0.03 $cm^{-1}$.

Methods for reducing the opening ratio include a method wherein a cover such as a floating cover is provided on the surface of the photographic processing solution in the processing bath; a method using a movable cover as described in JP-A-62-241342; and a slit processing method described in JP-A-63-216050.

The desilverization stage of the present invention is illustrated below.

The desilverization stage may comprises generally a bleaching stage-fixing stage; a fixing stage-bleaching and fixing stage; a bleaching stage-bleaching and a fixing stage; and a bleaching and fixing stage.

Bleaching solutions, bleaching-fixing solutions and fixing solutions which can be used in the present invention are illustrated below.

Any of the conventional bleaching agents can be used in the bleaching solutions or bleaching-fixing solutions of the present invention. Particularly preferred are organic complex salts of iron(III) (e.g., complex salts of aminopolycarboxylic acids such as ethylenediaminetetraacetic acid and diethylenetriaminepentaacetic acid, aminopolyphosphonic acids and phosphonocarboxylic acids) or organic acids such as citric acid, tartaric acid and malic acid; persulfates; and peroxide.

Among them, organic complex salts of iron(III) are particularly preferred from the standpoint of rapid processing and prevention of environmental pollution. Examples of aminopolycarboxylic acids, aminopolyphosphonic acids, organic phosphonic acids and salts thereof which are useful in preparing the organic complex salts of iron(III) include ethylenediaminetetraacetic acid, diethylenetriaminepentaacetic acid, 1,3-diaminopropanetetraacetic acid, propylenediaminetetraactic acid, nitrilotriacetic acid, cyclohexanediaminetetraacetic acid, methyliminodiacetic acid, iminodiacetic acid and glycol ether diaminetetraacetic acid. These compounds may be in the form of a salt such as the sodium, potassium, lithium or ammonium salt. Among them, iron(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred because they have a high bleaching power. The iron(III) complex salts may be previously prepared and used in the form of an iron(III) complex salt. Alternatively, a ferric salt such as ferric sulfate, ferric chloride, ferric nitrate, ammonium ferric sulfate or ferric phosphate is reacted with a chelating agent such as an aminopolycarboxylic acid, an aminopolyphosphonic acid or a phosphonocarboxylic acid in the processing solution to form a ferric ion complex salt in the solution. An excess amount of the chelating agent may be used. Among the iron complex salts, the iron complex salts of the aminopolycarboxylic acids are preferred. The complex salts are used in an amount of 0.01 to 1.0 mol/l, preferably 0.05 to 0.50 mol/l.

Bleaching solutions and bleaching-fixing solutions are fully described in Japanese Patent Application No. 3-255889 and these can be used.

Conventional fixing agents can be used in bleaching-fixing solutions or in fixing solutions. Examples of suitable fixing agents include solvents for silver halide, such as thiosulfates (e.g., sodium thiosulfate, ammonium thiosulfate), thiocyanates (e.g., sodium thiocyanate, ammonium thiocyanate), thioether compounds (e.g., ethylenebisthioglycolic acid, 3,6-dithia-1,8-octanediol), nitrogen-containing heterocyclic compounds having thioureas and a sulfido group, mesoionic compounds and thioether compounds. These compounds may be used either alone or as a mixture of two or more of them. The fixing agents are used in an amount of preferably at least 0.1 mol, more preferably 0.3 to 2.0 mol per liter of the fixing solution. The bleaching-fixing solutions or the fixing solutions have a pH of preferably 2 to 8, more preferably 3 to 5.

Further, the bleaching-fixing solutions may contain fluorescent brighteners, anti-foaming agents, surfactants, polyvinyl pyrrolidone or organic solvents such as methanol.

It is preferred for the bleaching-fixing solutions and the fixing solutions to contain sulfite ion-releasing compounds such as sulfites (e.g., sodium sulfite, potassium sulfite), bisulfites (e.g., ammonium bisulfite, sodium bisulfite, potassium bisulfite) or metabisulfites (e.g., potassium metabisulfite, sodium metabisulfite, ammonium metabisulfite). These compounds are used in an amount of preferably about 0.02 to 0.5 mol/l, more preferably 0.04 to 0.40 mol/l, as sulfite ion.

Further, ascorbic acid, sulfinic acids, carbonyl bisulfite adducts or carbonyl compounds may be employed.

Furthermore, buffering agents, fluorescent brighteners, chelating agents, anti-foaming agents, antifungal agents, etc. may be optionally employed.

The processing time with the bleaching-fixing solutions of the present invention is 5 to 120 seconds, preferably not longer than 60 seconds, particularly preferably not longer than 25 seconds. The processing temperature is 25° to 60° C., preferably 30° to 50° C.

After desilverization such as the fixing stage or the bleaching-fixing stage, rinsing and/or stabilization (hereinafter rinsing includes stabilization unless otherwise stated) are/is generally carried out.

The amount of rinsing water in the rinsing stage widely varies depending on the characteristics and use of the light-sensitive materials (e.g., depending on materials to be used such as couplers), the temperature of the rinsing water, the number of rinsing baths (the number of stages), the nature of the replenishment system such as a countercurrent system or a direct flow system and other conditions. The number of stages in the multi-stage countercurrent system is preferably 2 to 6, particularly preferably 2 to 5.

According to the multi-stage countercurrent system, the amount of rinsing water can be greatly reduced. For example, the amount of rinsing water can be reduced to 0.05 to 1.0 l per $m^2$ of the light-sensitive material, and the effect of the present invention is marked. However, the residence time of water in the tank is prolonged, and a problem that bacteria grow and floating matter formed deposits on the light-sensitive materials occurs. A method for reducing calcium and magnesium described in JP-A-62-288838 can be effectively used to solve the above-described problem. Further, isothiazolone compounds and thiabendazoles described in JP-A-57-8542, chlorine germicides such as sodium chlorinated isocyanurate described in JP-A-61-120145 and germicides such as benztriazole and copper ion described in JP-A-61-267761 can be used.

Further, the rinsing water can contain surfactants as draining agents and chelating agents such as EDTA as typically water softeners.

The light-sensitive materials are processed with a stabilizing solution after the rinsing stage, or may be directly processed with the stabilizing solution without the rinsing stage. Compounds capable of stabilizing an image are employed in the stabilizing solution. Examples of such compounds include aldehyde compounds such as typically formaldehyde, buffering agents for adjusting the pH to a value suitable for stabilizing dyes and ammonium compounds. Further, the above-described germicides and antifungal agents can be employed to prevent bacteria from growing in the rinsing solution or to impart antifungal properties to the processed light-sensitive materials.

Details of the stabilization stage and the rinsing stage in the processing of the light-sensitive material are described in Japanese Patent Application No. 3-255889.

The processing time in the present invention is defined as the time until the drying stage is completed after the light-sensitive material is brought into contact with the color developing solution. The effect of the present invention is remarked in rapid processing wherein the processing time is 4 minutes or less, preferably 2 minutes or less.

The drying stage which can be used in the present invention is illustrated below.

It is desirable for the drying time to be 60 seconds or less, particularly preferably 5 to 40 seconds to complete the formation of an image in the ultra-high rapid processing used in the present invention.

The drying time can be shortened by improving the light-sensitive material or the dryer. In the method for shortening the drying time by improving the light-sensitive material, the amount of hydrophilic binder such as gelatin is reduced to thereby reduce the amount of water present in the layers, whereby the drying time can be shortened. In another embodiment, water is absorbed by means of squeeze rollers or a cloth immediately after the light-sensitive material leaves the rinsing bath to thereby reduce the amount of water brought over from the rinsing bath, and as a result drying can be expedited. In the method for shortening the drying time by improving the dryer, the drying temperature is elevated or the rate of drying air is increased, whereby drying can be expedited. Further, drying can be expedited by controlling the angle of drying air blown against the light-sensitive material or improving the method for removing discharged air.

In the present invention, amidines or bisguanidines are present in the processing solution having a bleaching ability and containing a ferric salt of an organic acid in a method for processing a silver halide color photographic material which comprises subjecting the silver halide color photographic material to imagewise exposure, color development and then a desilverization treatment. Accordingly, even when ultra-high rapid processing is carried out, color developing agents and dyes can be easily washed from the color photographic material. Hence the formation of stain on the white area of image does not increase. In another embodiment, when a silver halide photographic material is processed, processing is carried out in the presence of a stilbene fluorescent brightener by using a desilverization bath containing a bleaching solution, a bleaching-fixing solution or a fixing solution, each solution containing an amidine or bisguanidine compound. In the processing, sensitizing dyes can be easily washed from the silver halide photographic material, and stain can be prevented even when ultra-high rapid processing is carried out. This processing can be applied to white and black photographic materials, and the effect of the present invention can be obtained.

EXAMPLES

The present invention is now illustrated in greater detail by reference to the following examples which, however, are not to be construed as limiting the present invention in any way. Unless otherwise indicated, all parts, percents, ratios and the like are by weight.

EXAMPLE 1

Preparation of Light-Sensitive Material

Both sides of a paper support were laminated with polyethylene. The surface of the support was subjected to a corona discharge treatment, and a gelatin undercoat layer containing sodium dodecylbenzenesulfonate was provided thereon. Further, the following photographic layers were coated on the support to prepare a multi-layer color photographic paper having the following layer structure as a sample. Coating solutions were prepared in the following manner.

Preparation of Coating Solution for First Layer 153.0 g of yellow coupler (ExY), 15.0 g of dye image stabilizer (Cpd-1), 7.5 g of dye image stabilizer (Cpd-2) and 16.0 g of dye image stabilizer (Cpd-3) were dissolved in 25 g of solvent (Solv-1), 25 g of solvent (Solv-2) and 180 cc of ethyl acetate. The resulting solution was emulsified and dispersed in 1000 cc of a 10% aqueous solution of gelatin containing 60 cc of 10% sodium dodecylbenzenesulfonate and 10 g of citric acid to prepare an emulsified dispersion A.

Separately, a silver chlorobromide emulsion A (cubic; a 3:7 (by Ag mol) mixture of a larger-size emulsion A having a mean grain size of 0.88 μm and a smaller-size emulsion A having a mean grain size of 0.70 μm; a coefficient of variation in grain size distribution: 0.08 and 0.10, respectively; 0.3 mol % of silver bromide being localized on a part of the surface of the grain in each size emulsion) was prepared. To the larger-size emulsion A, there was added $2.0\times10^{-4}$ mol (per mol of silver) of each of the following blue-sensitive sensitizing dyes A and B. To the smaller-size emulsion A, there was added $2.5\times10^{-4}$ mol (per mol of silver) of each of the following blue-sensitive sensitizing dyes A and B. Chemical ripening of the emulsion was carried out by adding a sulfur sensitizing agent and a gold sensitizing agent.

The emulsified dispersion A and the silver chlorobromide emulsion A were mixed and dissolved, and a coating solution for the First Layer was prepared to provide the following composition.

Preparation of Coating Solutions for Second Layer through Seventh Layer

Coating solutions for the Second Layer through the Seventh Layer were prepared in the same manner as in the preparation of the coating solution for the First Layer.

Each of the coating solutions was coated on the support to prepare a light-sensitive material having a layer structure described hereinafter as a sample.

The sodium salt of 1-oxy-3,5-dichloro-s-triazine was used as a hardening agent for gelatin in each layer.

Cpd-14 and Cpd-15 were added to each layer in an amount so as to provide total coating weights of 25.0 mg/m² and 50 mg/m², respectively.

The following spectral sensitizing dyes were used in the silver chlorobromide emulsions of the light-sensitive emulsion layers.

Blue-Sensitive Emulsion Layer

Sensitizing Dye A

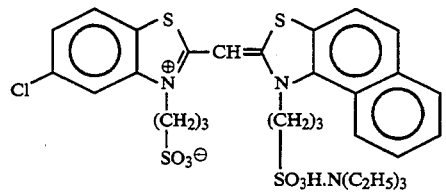

Sensitizing Dye B

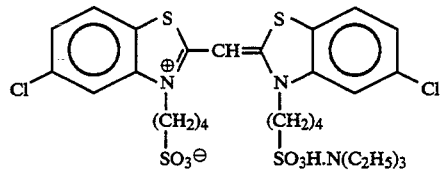

($2.0\times10^{-4}$ mol of each of these dyes was added to the larger-size emulsion, and $2.5\times10^{-4}$ mol of each of these dyes was added to the smaller-size emulsion, each amount being per mol of silver halide)

Green-Sensitive Emulsion Layer

Sensitizing Dye C

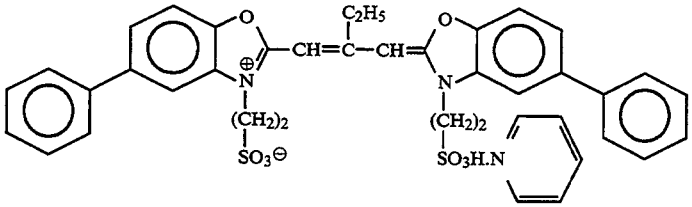

($4.0\times10^{-4}$ mol was added to the larger-size emulsion, and $5.6\times10^{-4}$ mol was added to the smaller-size emulsion, each amount being per mol of silver halide)

Sensitizing Dye D

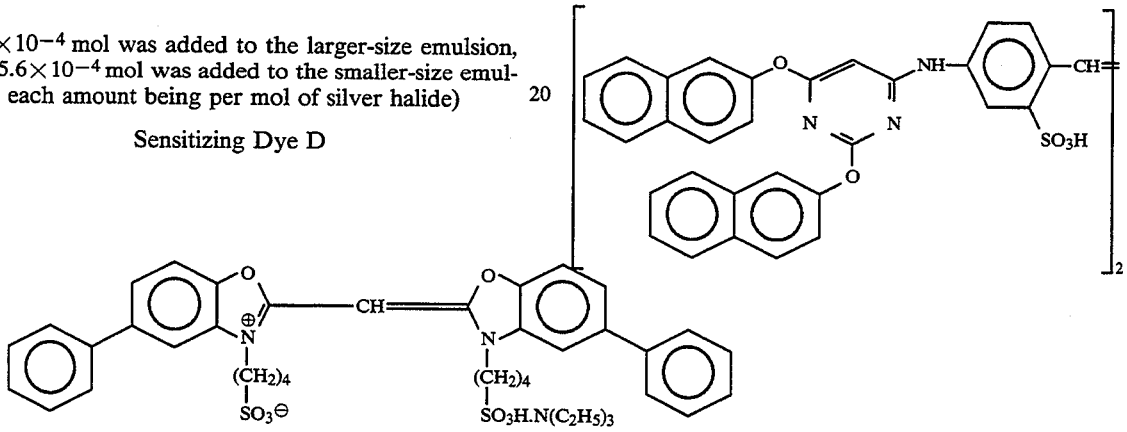

($7.0\times10^{-5}$ mol was added to the larger-size emulsion, and $1.0\times10^{-4}$ mol was added to the smaller-size emulsion, each amount being per mol of silver halide)

Red-sensitive Emulsion Layer

Sensitizing Dye E

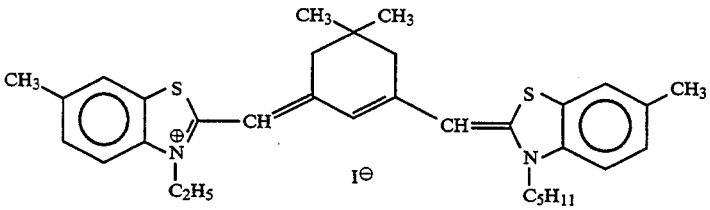

($0.9\times10^{-4}$ mol was added to the larger-size emulsion, and $1.1\times10^{-4}$ mol was added to the smaller-size emulsion, each amount being per mol of silver halide)

Further, $2.6\times10^{-3}$ mol of the following compound per mol of silver halide was added.

$8.5\times10^{-5}$ mol, $7.7\times10^{-4}$ mol and $2.5\times10^{-4}$ mol of 1-(5-methylureidophenyl)-5-mercaptotetrazole were added to the blue-sensitive emulsion layer, the green-sensitive emulsion layer and the red-sensitive emulsion layer respectively, each amount being per mol of silver halide.

Further, $1\times10^{-4}$ mol and $2\times10^{-4}$ mol of 4-hydroxy-6-methyl-1,3,3a,7-tetrazaindene were added to the blue-sensitive emulsion layer and the green-sensitive emulsion layer, respectively, each amount being per mol of silver halide.

The following dyes (the numerals in parentheses being coating weights) were added to the emulsion layers to prevent irradiation.

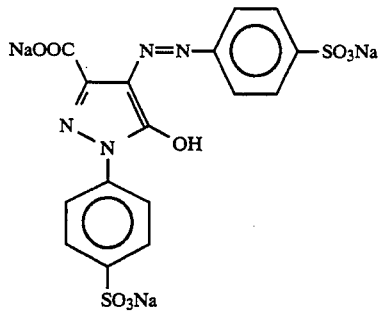

(10 mg/m²)

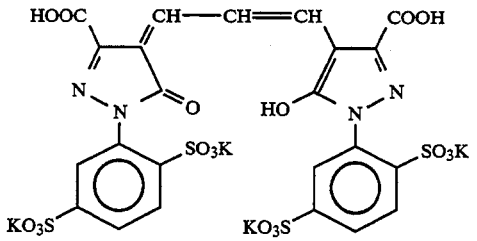

(10 mg/m²)

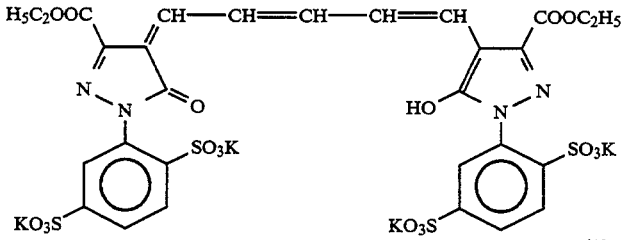

(40 mg/m²)

and

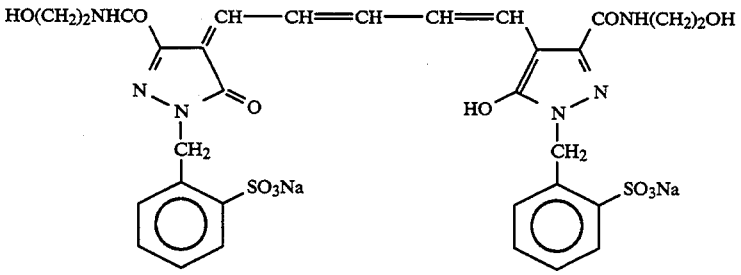

(20 mg/m²)

Layer Structure

Each layer had the following composition. The numerals represent the coating weight (g/m²). The amounts of the silver halide emulsions are represented as the coating weight in terms of silver.

| | |
|---|---|
| Support | |
| Polyethylene-laminated paper | |
| [Polyethylene on the first layer side contained a white pigment ($TiO_2$) and a bluish dye (ultramarine)] | |
| First Layer (blue-sensitive emulsion layer) | |
| The above silver chlorobromide emulsion A | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second Layer (color mixing inhibiting layer) | |

-continued

| | |
|---|---|
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |
| Third Layer (green-sensitive emulsion layer) | |
| Silver chlorobromide emulsion (cubic; a 1:3 (by Ag mol) mixture of a larger-size emulsion B having a mean grain size of 0.55 μm and a smaller-size emulsion B having a mean grain size of 0.39 μm; a coefficient of variation in grain size distribution: 0.10 and 0.08, respectively; 0.8 mol % of AgBr being localized on a part of the surface of the grain in each size emulsion) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixing inhibiting layer) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (red-sensitive emulsion layer) | |
| Silver chlorobromide emulsion (cubic; a 1:4 (by Ag mol) mixture of a larger-size emulsion C having a mean grain size of 0.50 μm and a smaller-size emulsion C having a mean grain size of 0.41 μm; a coefficient of variation in grain size distribution: 0.09 and 0.11, respectively; 0.8 mol % of AgBr being localized on a part of the surface of the grain in each size emulsion) | 0.18 |
| Gelatin | 0.80 |
| Cyan coupler (ExC) | 0.33 |
| Dye image stabilizer (Cpd-1) | 0.35 |
| Ultraviolet light absorber (UV-2) | 0.18 |
| Dye image stabilizer (Cpd-9) | 0.15 |
| Dye image stabilizer (Cpd-10) | 0.15 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-l) | 0.01 |
| Sixth Layer (ultraviolet light absorbing layer) | |
| Gelatin | 0.55 |
| Ultraviolet light absorber (UV-l) | 0.38 |
| Dye image stabilizer (Cpd-12) | 0.15 |
| Dye image stabilizer (Cpd-5) | 0.02 |
| Seventh Layer (protective layer) | |
| Gelatin | 1.13 |
| Acrylic-modified copolymer of polyvinyl alcohol (a degree of modification: 17%) | 0.05 |
| Liquid paraffin | 0.02 |
| Dye image stabilizer (Cpd-13) | 0.01 |

(ExY) Yellow Coupler
1:1 mixture (by mol)

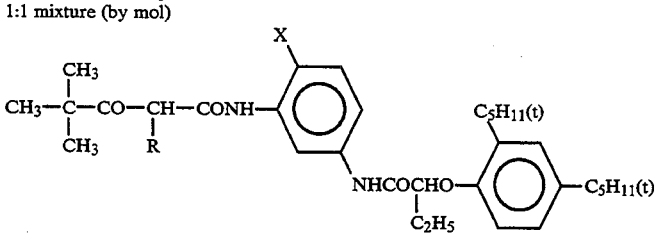

R =

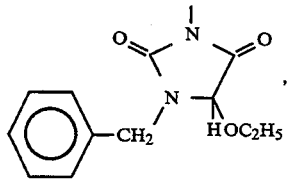

, X = Cl andd

-continued
R = 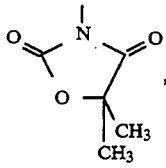 , X = $OCH_3$
(ExM) Magenta Coupler
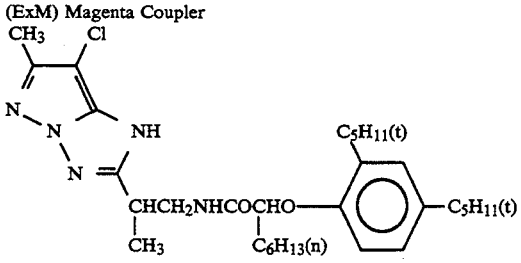
(ExC) Cyan Coupler
3:7 mixture (by mol)
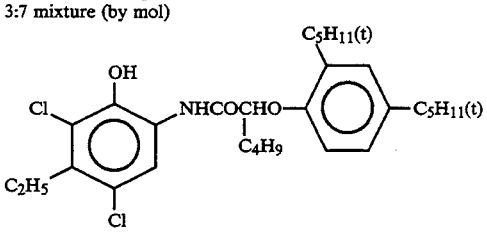
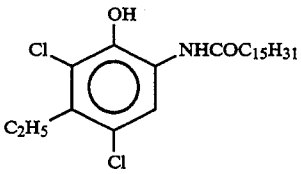
(Cpd-1) Dye Image Stabilizer
$-(CH_2-CH)_n-$ (Average MW 60,000)
$CONHC_4H_9(t)$
(Cpd-2) Dye Image Stabilizer
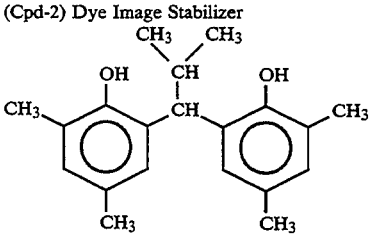
(Cpd-3) Dye Image Stabilizer
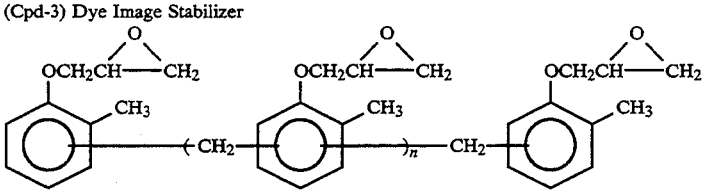
n = 7–8 (mean value)
(Cpd-4) Color Mixing Inhibitor
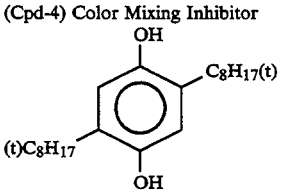

-continued
(Cpd-5) Dye Image Stabilizer
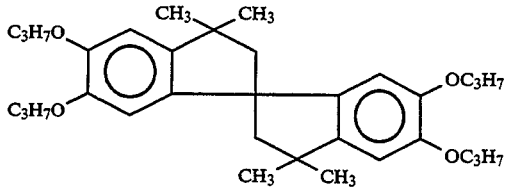
(Cpd-6)
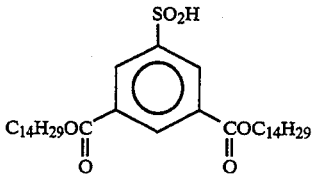
(Cpd-7)
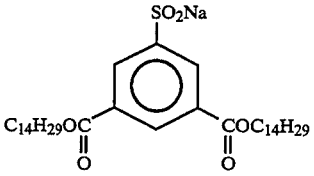
(Cpd-8) Dye Image Stabilizer
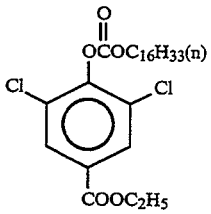
(Cpd-9) Dye Image Stabilizer
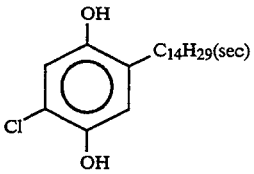
(Cpd-10) Dye Image Stabilizer
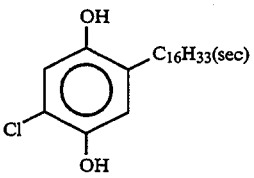
(Cpd-11)
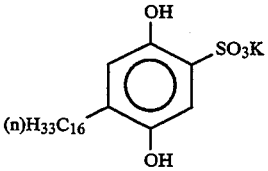
(Cpd-12)

-continued
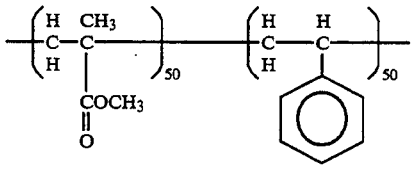
Average MW 60,000
(Cpd-13)
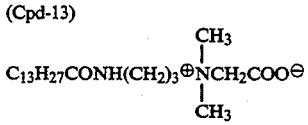
(Cpd-14) Preservative
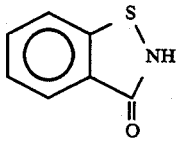
(Cpd-15) Preservative
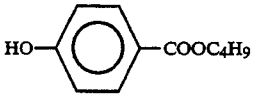
(UV-1) Ultraviolet Light Absorber
(i), (ii), (iii), (iv) (10:5:1:5 by weight) mixture
(i)
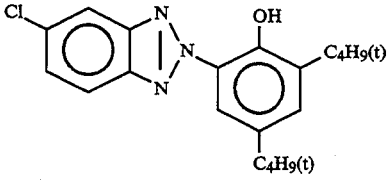
(ii)
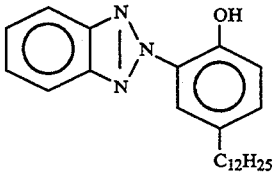
(iii)
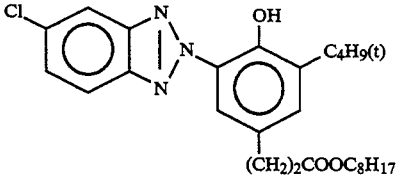
(iv)
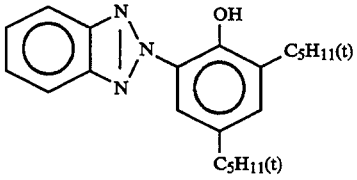
(UV-2) Ultraviolet Light Absorber
(1) (2) (3) (1:2:2 by weight) mixture
(1)
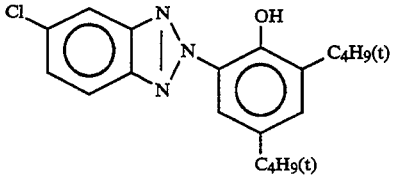
(2)
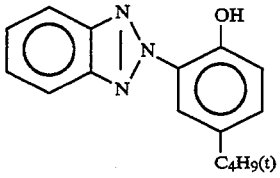
(3)
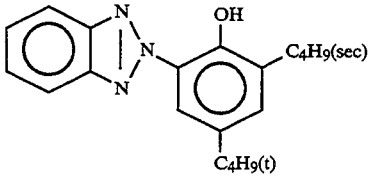
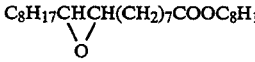
(Solv-1) Solvent
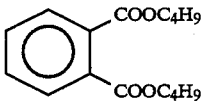
(Solv-2) Solvent
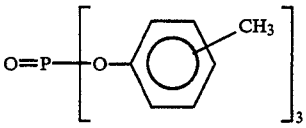
(Solv-3) Solvent -continued

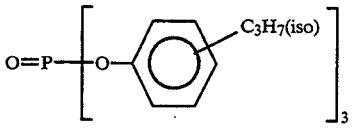

(Solv-4) Solvent

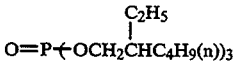

(Solv-5) Solvent

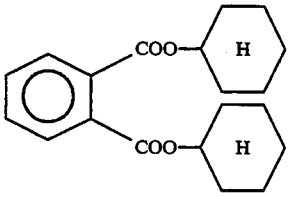

(Solv-6) Solvent

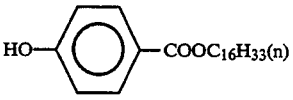

(Solv-7) Solvent

The thus-prepared sample was cut into pieces. The resulting samples were subjected to gradation exposure through a three-color separation filter for sensitometry, or exposed through a resolving power test chart using a sensitometer (FW type, color temperature of light source: 3200° K., manufactured by Fuji Photo Film Co., Ltd.).

The exposed samples were subjected to continuous processing (running test) in the following processing steps using a color developing solution having the following composition until the color developing solution was replenished in an amount equal to the capacity of the tank.

| Processing Step | Temp. | Time | Replenishment Rate* | Tank Capacity |
|---|---|---|---|---|
| Color Development | 40° C. | 15 sec. | 35 ml | 2 l |
| Bleaching-Fixing | 40° C. | 15 sec. | 35 ml | 2 l |
| Rinse (1) | 40° C. | 3 sec. | — | 1 l |
| Rinse (2) | 40° C. | 3 sec. | — | 1 l |
| Rinse (3) | 40° C. | 3 sec. | — | 1 l |
| Rinse (4) | 40° C. | 3 sec. | — | 1 l |
| Rinse (5) | 40° C. | 6 sec. | 60 ml | 1 l |
| Drying | 60–80° C. | 15 sec. | | |

*Replenishment rate being per $m^2$ of the light-sensitive material.
(A five-tank countercurrent system of rinse (5) → rinse (1) was used.)

In the above processing, water from rinse (5) was pressure-fed to a reverse osmosis membrane, transmitted water was fed to rinse (5), and concentrated water which was not transmitted through the reverse osmosis membrane was returned to rinse (4) and used. Blades were provided between the rinse baths to shorten cross-over time and water was passed between the blades.

Each processing solution had the following composition.

| Color Developing Solution | Tank Solution | Replenisher |
|---|---|---|
| Water | 700 ml | 700 ml |
| Ethylenediaminetetraacetic acid | 1.5 g | 3.75 g |
| Sodium triisopropyl-naphthalene-β-sulfonate | 0.01 g | 0.01 g |
| Disodium 1,2-dihydroxybenzene-4,6-disulfonate | 0.25 g | 0.7 g |
| Triethanolamine | 5.8 g | 14.5 g |
| Potassium chloride | 10.0 g | — |
| Potassium bromide | 0.03 g | — |
| Potassium carbonate | 30.0 g | 39.0 g |
| Fluorescent brightener (UVITEX CK manufactured by Ciba-Geigy) | 2.5 g | 5.0 g |
| Sodium sulfite | 0.14 g | 0.2 g |
| Disodium N,N-bis(sulfonato-ethyl)hydroxylamine | 7.4 g | 15.0 g |
| 4-Amino-3-ethyl-N-ethyl-N-(4-hydroxybutyl)aniline di-p-toluenesulfonate | 14.5 g | 35.0 g |
| Add water to make | 1000 ml | 1000 ml |
| pH (25° C.) | 10.05 | 11.60 |

| Bleaching-Fixing Solution | Tank Solution |
|---|---|
| Water | 600 ml |
| Ammonium thiosulfate (70% aq. soln) | 100 ml |
| Ammonium sulfite | 40 g |
| Ammonium ethylenediaminetetraacetate ferrate | 77 g |
| Disodium ethylenediaminetetraacetate | 5 g |
| Ammonium bromide | 10 g |
| Amidines or bisguanidines | 0.05 mol |
| Acetic acid (50% aq. soln) | 25 ml |
| Add water to make | 1000 ml |
| pH (25° C.) (adjusted with acetic acid or ammonia water) | 5.5 |

The replenisher had the same composition as that of the tank solution except that the pH of the replenisher was 5.0.

Rinsing Solution

Ion-exchanged water (the amount of each of calcium ion and magnesium ion was reduced to 3 ppm or less).

For the purpose of comparison, bleaching-fixing solutions containing the following comparative compounds in place of the amidines or the bisguanadines were used.

1 $(C_4H_9)_4N^{\oplus}.Cl^{\ominus}$

2

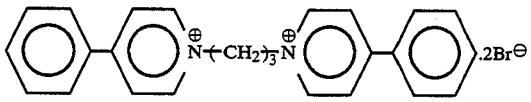

3

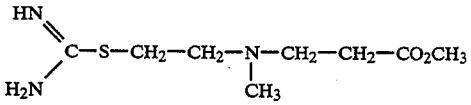

4

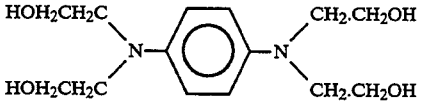

5

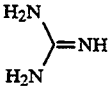

-continued

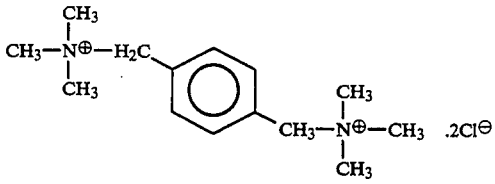

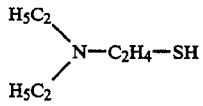

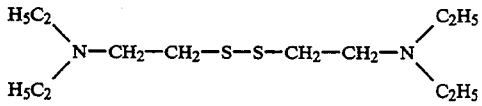

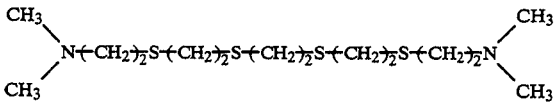

Determination of Amount of Developing Agent Remaining

After the samples were processed, any extra amount of the solution deposited on the surface of the layer of the light-sensitive material was removed. Subsequently, each sample was placed in acetic acid and ethyl acetate to extract the color developing agent remaining in the layers of the light-sensitive material, and the amount of the color developing agent remaining in the layers thereof was determined.

Evaluation of Resolving Power

After processing, the samples (exposed through a resolving power test chart) were maintained in an air-conditioned device for 8 days. This device was air-conditioned at 80° C. and 70% RH, and the blurring of cyan dye formed on the samples was observed. The degree of blurring was visually evaluated. The evaluation was made by using the following criteria.

Resolving power:

Symbol ○ in Table 1: at least 5 lines/mm

Symbol Δ in Table 1: 2 to 5 lines/mm

Symbol × in Table 1: 2 lines or less/mm

The results obtained are shown in Table 1 below.

TABLE 1

| Sample No. | | Compound | Amount of Developing Agent Remaining (μmole/m²) | Resolving Power |
|---|---|---|---|---|
| 1 | Comp. Ex. | None Comparative Compound | 40 | ○ |
| 2 | " | 1 | 22 | × |
| 3 | " | 2 | 20 | × |
| 4 | " | 3 | 38 | × |
| 5 | " | 4 | 40 | ○ |
| 6 | " | 5 | 40 | ○ |
| 7 | Invention | B-1 | 10 | ○ |
| 8 | " | B-2 | 7 | ○ |
| 9 | " | B-8 | 8 | ○ |
| 10 | " | B-18 | 15 | ○ |
| 11 | " | AM-1 | 24 | ○ |
| 12 | " | AM-9 | 22 | Δ |
| 13 | " | BA-1 | 5 | Δ |
| 14 | " | BA-4 | 10 | ○ |
| 15 | " | BA-16 | 15 | ○ |
| 16 | " | BA-22 | 7 | Δ |

It can be seen from the results in Table 1 above that when ultra-high rapid processing is carried out using the bleaching-fixing solutions containing the amidines or bisguanidines of the present invention, the amount of developing agent remaining in the light-sensitive materials is small, and the resolving power of the image is good after the samples are stored under high temperature and humidity conditions.

Further, it was found that there is little difference in desilverization performance between these compounds (including comparative compounds) and bleaching is not remarkably accelerated by specific compounds.

EXAMPLE 2

A light-sensitive material was prepared in the same manner as in Example 1 except that the dyes for preventing irradiation were omitted from the light-sensitive material of Example 1.

The thus-prepared light-sensitive material was cut into pieces. The resulting samples were processed in the following processing steps without exposure to light. The fluorescent brighteners indicated in Table 2 were used in the color developing solution in this processing stage, and the amidines or the bisguanidines indicated in Table 2 were used in the bleaching-fixing solution. The same bleaching-fixing solution as that used in Example 1 was used.

| Processing Step | Temperature | Time |
|---|---|---|
| Color Development | 40° C. | 25 sec. |
| Bleaching-Fixing | 38° C. | 15 sec. |
| Rinse (1) | 40° C. | 7 sec. |
| Rinse (2) | 40° C. | 7 sec. |
| Rinse (3) | 40° C. | 7 sec. |
| Drying | 60–80° C. | 15 sec. |

(Three tank countercurrent system of rinse (3) → rinse (1) was used.)

Color Developing Solution

| | |
|---|---|
| Water | 700 ml |
| Sodium triisopropylnaphthalene-β-sulfonate | 0.1 g |
| Ethylenediaminetetraacetic acid | 3.0 g |
| Disodium 1,2-dihydroxybenzene-4,6-disulfonate | 0.5 g |
| Triethanolamine | 12.0 g |
| Potassium chloride | 10.0 g |
| Potassium bromide | 0.03 g |
| Potassium carbonate | 27.0 g |
| Fluorescent brightener | 0.001 mol |
| Sodium sulfite | 0.1 g |
| Disodium N,N-bis(sulfonatoethyl)-hydroxylamine | 10.0 g |
| N-Ethyl-N-(β-methanesulfonamidoethyl)-3-methyl-4-aminoaniline sulfate | 9.5 g |
| Add water to make | 1000 ml |
| pH (25° C.) | 10.35 |

Evaluation of Amount of Sensitizing Dye Remaining

The processed samples were tested, and the reflection spectra of the surfaces of the layers of the light-sensitive materials were measured using a spectrophotometer manufactured by Hitachi Ltd. Since stain caused by the sensitizing dye used in the BL layer was heavy, the level of stain was evaluated by the value of absorbance at 450 nm corresponding to the absorption peak of the sensitizing dye.

The results obtained are shown in Table 2 below.

TABLE 2

| Sample No. | | Fluorescent Brightener | Amidines or Bisquanidines | Amount of Developing Agent Remaining ($\mu$mole/m$^2$) | Absorbance (450 nm) |
|---|---|---|---|---|---|
| 17 | Comp. Ex. | None | None | 50 | 0.087 |
| 18 | " | F-1 | None | 50 | 0.075 |
| 19 | " | F-7 | None | 50 | 0.090 |
| 20 | Invention | None | B-1 | 12 | 0.084 |
| 21 | " | None | AM-1 | 26 | 0.082 |
| 22 | " | None | BA-10 | 8 | 0.086 |
| 23 | " | F-1 | B-1 | 12 | 0.065 |
| 24 | " | " | AM-1 | 25 | 0.067 |
| 25 | " | " | BA-10 | 8 | 0.065 |
| 26 | " | F-7 | B-1 | 12 | 0.065 |
| 27 | " | " | B-9 | 8 | 0.065 |
| 28 | " | " | AM-1 | 25 | 0.064 |
| 29 | " | " | BA-10 | 8 | 0.065 |
| 30 | " | " | BA-11 | 15 | 0.067 |
| 31 | " | " | BA-16 | 18 | 0.066 |
| 32 | " | F-3 | BA-10 | 8 | 0.066 |
| 33 | " | F-6 | " | 8 | 0.067 |
| 34 | " | F-9 | " | 8 | 0.066 |
| 35 | " | F-17 | " | 8 | 0.064 |

In the above Table, when Fluorescent Brighteners F-3, F-6, F-9 and F-17 and Amidines or Bisguanidines BA-11 and BA-16 alone were used, no effect of accelerating the removal of the sensitizing dye was obtained as in the case of no addition.

It can be seen from the results in Table 2 that when only the amidines or bisguanidines of the present invention are used in the bleaching-fixing solution, while the removal of the sensitizing dye is sufficient, when the triazilstilbene fluorescent brighteners are additionally used in the developing solution, the removal of the sensitizing dye can be accelerated in comparison with the case where the amidines or the bisguanidines alone are used.

EXAMPLE 3

A light-sensitive material prepared below was used as a sample in place of the light-sensitive material used as the sample in Example 1.

Preparation of Emulsion (a)

To a 3% aqueous solution of lime-processed gelatin, there was added 3.3 g of sodium chloride. Subsequently, 3.2 ml of N,N'-dimethylimidazolidine-1-thione (2% aqueous solution) was added thereto. An aqueous solution containing 0.2 mol of silver nitrate and an aqueous solution containing 0.2 mol of sodium chloride and 15 $\mu$g of rhodium trichloride were added to the above described aqueous solution with vigorous stirring at 56° C. Subsequently, an aqueous solution containing 0.780 mol of silver nitrate and an aqueous solution containing 0.780 mol of sodium chloride and 4.2 mg of potassium ferrocyanide were added thereto with vigorous stirring at 56° C. Five minutes after completion of the addition of the aqueous solution of silver nitrate and the aqueous solution of the alkali metal halide, an aqueous solution containing 0.02 mol of silver nitrate and an aqueous solution containing 0.015 mol of potassium bromide, 0.005 mol of sodium chloride and 0.8 mg of potassium hexachloroiridate(III) were added thereto with vigorous stirring at 40° C. An isobutene/monosodium maleate copolymer was added thereto, and precipitation, water washing and desalting were carried out. Further, 90.0 g of lime-processed gelatin was added thereto. The pH of the gelatin was adjusted to 6.2, and the pAg thereof was adjusted to 6.5. Subsequently, a sulfur sensitizing agent (triethylurea in an amount of $1\times10^{-5}$ mol/mol of Ag), chloroauric acid ($1\times10^{-5}$ mol/mol of Ag) and nucleic acid (0.2 g/mol of Ag) were added thereto, and chemical sensitization was carried out optionally at 50° C.

The resulting silver chlorobromide emulsion (a) was examined, and the crystal form, grain size and grain size distribution of grains in the emulsion were determined from an electron micrograph. It was found that all of the silver halide grains were cubic, the mean grain size thereof was 0.52 $\mu$m, and the grains had a coefficient of variation of 0.08. The mean grain size was determined in the following manner. The diameter of the grain is defined as the diameter of a circle having an area equal to the projected area of the grain, and the average of the diameters of the circles is referred to as the mean grain size. The grain size distribution is the value obtained by dividing the standard deviation of grain size by the mean grain size.

The halogen composition of the grains was determined by measuring the silver halide crystal using X-ray diffraction. Monochromatic CuK $\alpha$-rays were used as a radiation source, and the angle of diffraction from the (200) face was fully measured. A diffraction pattern obtained from a crystal having a uniform halogen composition gives a single peak, while a diffraction pattern obtained from a crystal having a localized phase with a different halogen composition from that of the host crystal gives a plurality of peaks corresponding to the compositions. The halogen composition of the silver halide of the crystal can be determined by calculating the lattice constant from the angle of diffraction of the peaks.

The measurement of the silver chlorobromide emulsion (a) showed that in addition to a main peak of 100% silver chloride, a broad diffraction pattern wherein the center of the curve was 70% silver chloride (30% silver bromide) and the base of the curve was extended to the area of 60% silver chloride (40% silver bromide) was observed.

Preparation of Light-Sensitive Material as Sample 501

A light-sensitive material as Sample 501 was prepared in the same manner as in the preparation of the light-sensitive material of Example 1 except for the following.

The First Layer was a red-sensitive yellow color forming layer, the Third Layer was an infrared-sensitive magenta color forming layer, and the Fifth Layer was an infrared-sensitive cyan color forming layer. The following spectral sensitizing dyes were used.

First Layer (red-sensitive yellow color forming layer)
(Dye-1)

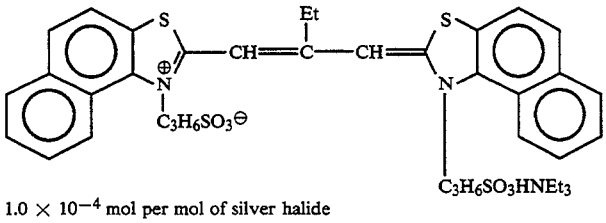

$1.0 \times 10^{-4}$ mol per mol of silver halide

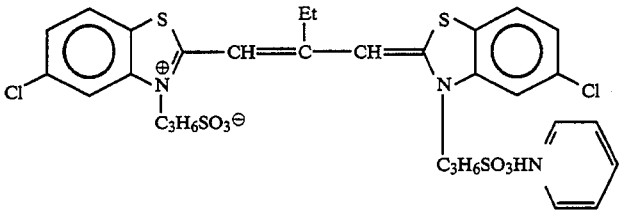

$1.0 \times 10^{-4}$ mol per mol of silver halide

Third Layer (infrared-sensitive magenta color forming layer)

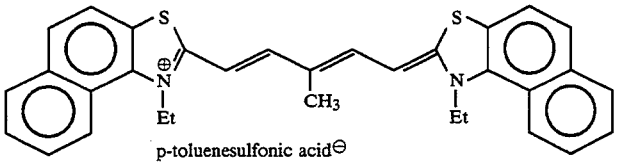

$4.5 \times 10^{-5}$ mol per mol of silver halide

Fifth Layer (infrared-sensitive cyan color forming layer)

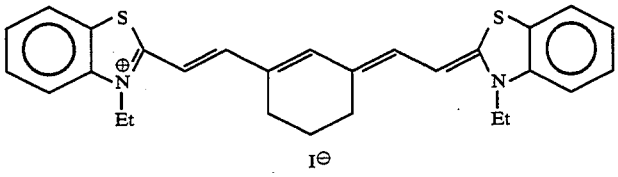

$1 \times 10^{-5}$ mol per mol of silver halide (Dye-4)

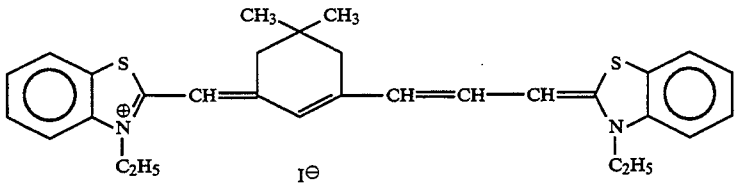

$1 \times 10^{-5}$ mol per mol of silver halide (Dye-5)

-continued
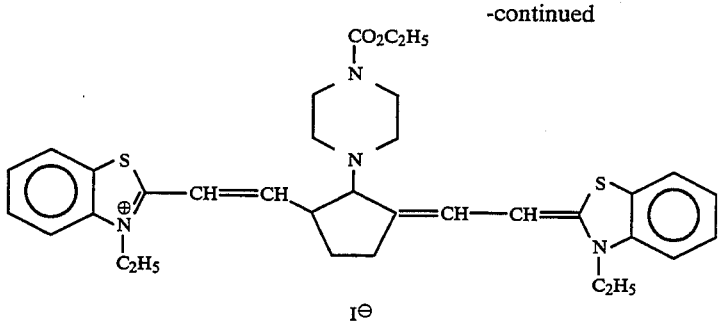
$1 \times 10^{-5}$ mol per mol of silver halide
Further, $8.0 \times 10^{-4}$ mol (per mol of silver halide) of 1-(5-methylureidophenyl)-5-mercaptotetrazole was added to each of the yellow color forming layer, the magenta color forming layer and the cyan color forming layer. The following dyes were added to the emulsion layers to prevent irradiation.
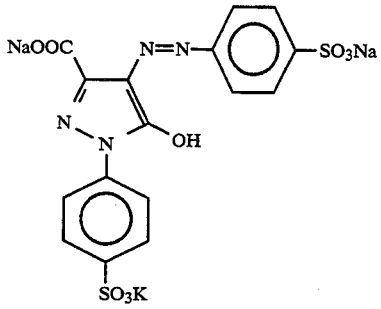
(10 mg/m²)
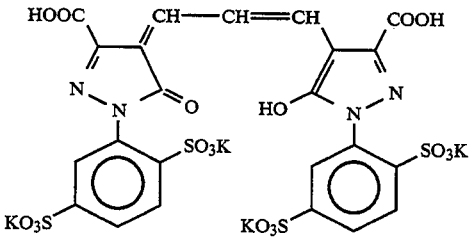
(10 mg/m²)
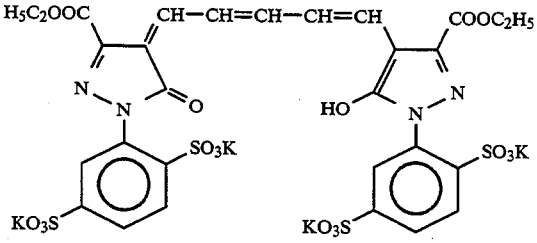
(40 mg/m²)
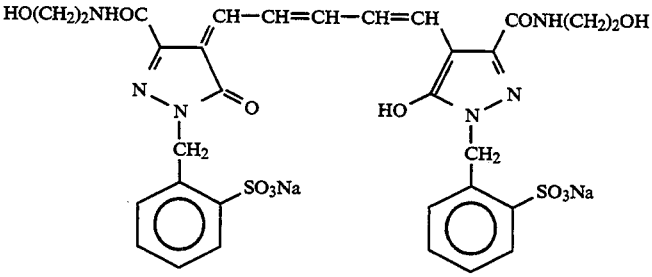
(20 mg/m²)

-continued

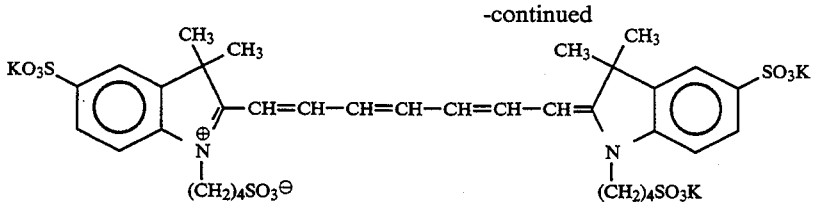

(10 mg/m²)

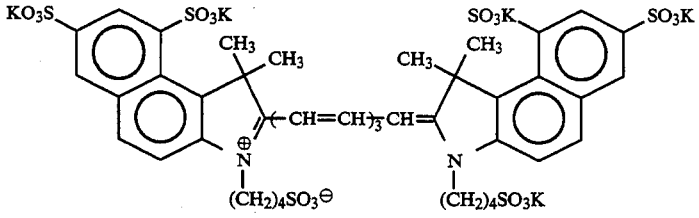

(5 mg/m²)

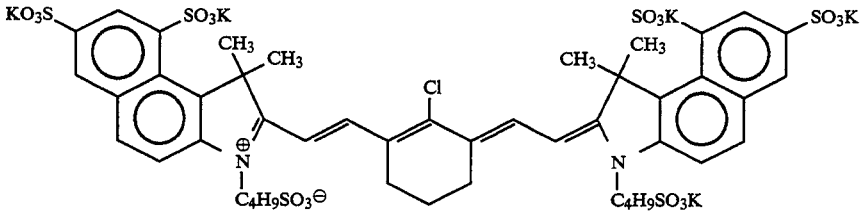

(5 mg/m²)

Layer Structure

Each layer had the following composition. The numerals represent the coating weight (g/m²). The amount of the silver halide emulsion is represented as a coating weight in terms of silver.

| Support | |
|---|---|
| First Layer (red-sensitive yellow color forming layer) | |
| Silver halide emulsion (a) | 0.30 |
| Gelatin | 1.22 |
| Second Layer (color mixing inhibiting layer) | |
| Gelatin | 0.64 |
| Third Layer (infrared-sensitive magenta color forming layer) | |
| Silver chlorobromide emulsion (a) | 0.12 |
| Gelatin | 1.28 |
| Fourth Layer (ultraviolet light absorbing layer) | |
| Gelatin | 1.41 |
| Fifth Layer (infrared-sensitive cyan color forming layer) | |
| Silver chlorobromide emulsion (a) | 0.23 |
| Gelatin | 1.04 |
| Sixth Layer (ultraviolet light absorbing layer) | |
| Gelatin | 0.48 |

Semiconductor lasers AlGaInP (oscillating wavelength: about 670 nm), GaAlAs (oscillating wavelength: about 750 nm) and GaAlAs (oscillating wavelength: about 830 nm) were used. The device was designed so that color photographic papers in turn were subjected to a scanning exposure to laser beams using a rotary polyhedron, while the color photographic papers were transferred in the direction perpendicular to the scanning direction. This device was used, and the relationship D-logE between the density (D) of an image on the light-sensitive material and the amount (E) of light was determined by varying the amount of light. The exposure amount to semiconductor laser beam was controlled by a combination of a pulse width modulation system where the amount of light was modulated by changing the electrifying time of semiconductor laser with an intensity modulation system wherein the amount of light was modulated by changing the amount of electricity. Scanning exposure was carried out with 400 dpi, and the average exposure time was about $10^{-7}$ seconds per pixel.

The exposed samples were subjected to continuous processing in the following processing stages by using the following color developing solution until the color developing solution was replenished with an amount equal to the tank capacity. The same bleaching-fixing solution as that described in Example 1 was used.

| Processing Step | Temp. | Time | Replenishment Rate* | Tank Capacity |
|---|---|---|---|---|
| Color Development | 38° C. | 45 sec. | 73 ml | 2 l |
| Bleaching-Fixing | 38° C. | 15 sec. | 35 ml | 2 l |
| Rinse (1) | 38° C | 5 sec.. | — | 1 l |
| Rinse (2) | 38° C. | 5 sec. | — | 1 l |
| Rinse (3) | 38° C. | 5 sec. | — | 1 l |
| Rinse (4) | 38° C. | 5 sec. | — | 1 l |
| Rinse (5) | 38° C. | 5 sec. | 60 ml | 1 l |
| Drying | 60–80° C. | 15 sec. | | |

*Replenishment rate per m² of the light-sensitive material.
(A five tank countercurrent system of rinse (5) → rinse (1) was used.)

Water from rinse (5) was pressure-fed to a reverse osmosis membrane, transmitted water was fed to rinse (5), and concentrated water which was not transmitted through the reverse osmosis membrane was returned to rinse ( 4) for use.

The color developing solution had the following composition.

| Color Developing Solution | Tank Solution | Replenisher |
|---|---|---|
| Water | 700 ml | 700 ml |
| Sodium triisopropyl-naphthalene-β-sulfonate | 0.1 g | 0.1 g |
| Ethylenediaminetetraacetic acid | 1.5 g | 3.0 g |
| Disodium 1,2-dihydroxybenzene-4,6-disulfonate | 0.3 g | 0.5 g |
| Triethanolamine | 6.0 g | 10.0 g |
| Potassium chloride | 6.5 g | — |
| Potassium bromide | 0.03 g | — |
| Potassium carbonate | 21.0 g | 27.0 g |
| Fluorescent brightener (UVITEX CK manufactured by Ciba-Geigy) | 1.6 g | 3.2 g |
| Disodium N,N-bis(sulfonato-ethyl)hydroxylamine | 10.0 g | 13.0 g |
| N-Ethyl-N-(β-methanesulfon-amidoethyl)-3-methyl-4-amino-aniline sulfate | 5.8 g | 11.5 g |
| Add water to make | 1000 ml | 1000 ml |
| pH (25° C.) | 9.97 | 11.00 |

Evaluation of Stain on Image

The minimum density ($D_{min}$) of the yellow density of the image obtained in the above process was measured through a B filter. Subsequently, the resulting samples were stored in an air-conditioned device for 10 days, with this device being air-conditioned at 60° C. and 70% RH, and the minimum density of each sample was measured. An increase in yellow density after storage from that before storage is represented by $\Delta D_{min}$.

The amount of color developing agent remaining was evaluated in the same manner as in Example 1. The results obtained are shown in Table 3.

TABLE 3

| Sample No. | | Compound | Amount of Developing Agent Remaining (μmole/m²) | $\Delta D_{min}$ |
|---|---|---|---|---|
| 36 | Comp. Ex. | None Comparative Compound | 23 | 0.011 |
| 37 | " | 6 | 12 | 0.020 |
| 38 | " | 7 | 23 | 0.011 |
| 39 | " | 8 | 22 | 0.010 |
| 40 | " | 9 | 21 | 0.010 |
| 41 | " | 10 | 23 | 0.011 |
| 42 | Invention | B-1 | 5 | 0.001 |
| 43 | " | B-3 | 4 | 0.001 |
| 44 | " | B-6 | 4 | 0.001 |
| 45 | " | B-14 | 3 | 0.000 |
| 46 | " | AM-7 | 7 | 0.002 |
| 47 | " | AM-11 | 9 | 0.003 |
| 48 | " | BA-2 | 0 | 0.000 |
| 49 | " | BA-6 | 4 | 0.001 |
| 50 | " | BA-11 | 4 | 0.001 |

It can be seen from the results in Table 3 that when rapid bleaching-fixing and rinsing are carried out by using a bleaching-fixing solution containing the amidines or bisguanidines of the present invention, the amount of the developing agent remaining in the light-sensitive material is small, and the minimum density after storage under high temperature and humidity conditions is low. Further, no blurring of cyan image was observed.

According to the present invention, the amount of color developing agent remaining in the color photographic material is small, and an image can be obtained which scarcely suffers from the formation of stain after storage over a long period of time even when the color photographic material is ultra-high-rapid-processed using color developing agents. The resulting image has good resolving power. Further, even when the photographic materials are subjected to ultra-high rapid processing, stain due to sensitizing dyes and other dyes is scarcely formed. Particularly, when the photographic materials are processed in the presence of a stilbene fluorescent brightener using a desilverization bath, sensitizing dyes can be easily washed out, the formation of stain caused by the sensitizing dyes scarcely occurs, and minimum density is low.

In the present invention, the photographic materials are processed with a processing solution having a bleaching ability and containing an amidine compound or a bisguanidine compound. Accordingly, the color developing agents can be easily washed off from the color photographic materials. As a result, the formation of stain can be reduced. When the above-described processing is carried out in the presence of a stilbene fluorescent brightener, coloring materials such as dyes and sensitizing dyes can be easily washed off, and hence the present invention has the effect of reducing the formation of stain caused by the coloring materials such as dyes and sensitizing dyes.

While the invention has been described in detail and with reference to specific embodiments thereof, it will be apparent to one skilled in the art that various changes and modifications can be made therein without departing from the spirit and scope thereof.

What is claimed is:

1. A method for forming an image in a silver halide color photographic material comprising a support having thereon at least one light-sensitive silver halide emulsion layer which comprises image-wise exposing the silver halide color photographic material, color developing the exposed material in a color developing solution, and then subjecting the developed material to a desilverization treatment, wherein the desilverization treatment is carried out using a processing solution having a bleaching ability and containing at least one of an amidine compound or a bisguanidine compound and a ferric salt of an organic acid, wherein the amidine compound or the bisguanidine compound is a compound represented by the following general formula (1):

$$B_nA \quad (1)$$

wherein n represents an integer of 1 to 4; when n=1, A represents a hydrogen atom or an amino group, and B represents a residue formed by removing one hydrogen atom from an amidine represented by the following general formula (2); and when n≧2, A represents an n-valent organic residue having 10 carbon atoms or less, and B represents a residue formed by removing one hydrogen atom from an amidine or guanidine represented by the following general formula (2):

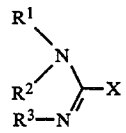

(2)

wherein $R^1$, $R^2$ and $R^3$ may be the same or different and each represents a hydrogen atom or an alkyl group having not more than 6 carbon atoms; X represents a hydrogen atom, an amino group, an alkyl group, an aryl group or a heterocyclic group, and each of these groups has 8 carbon atoms or less; or any two of $R^1_n$, $R^2_n$, $R^3_n$ and $X_n$ (wherein n is as defined above) may combine together to form a ring.

2. A method for forming an image in a silver halide photographic material as claimed in claim 1, wherein the light-sensitive silver halide emulsion comprises silver halide grains having a silver chloride content of at least 90 mol %.

3. A method for forming an image in a silver halide photographic material as claimed in claim 1, wherein the light-sensitive silver halide emulsion comprises silver halide grains having a silver chloride content of at least 90 mol %.

4. A method for forming an image in a silver halide color photographic material as claimed in claim 1, wherein the amidine compound or the bisguanidine compound has an acid dissociation constant (pKa) of at least 11.0 as measured at 25° C. in an aqueous solution.

5. A method for forming an image in a silver halide color photographic material as claimed in claim 1, wherein the replenishment rate of the processing solution having a bleaching ability is 30 to 120 ml/m$^2$.

6. A method for forming an image in a silver halide color photographic material as claimed in claim 1, wherein the amidine compound or the bisguanidine compound is selected from the group consisting of:

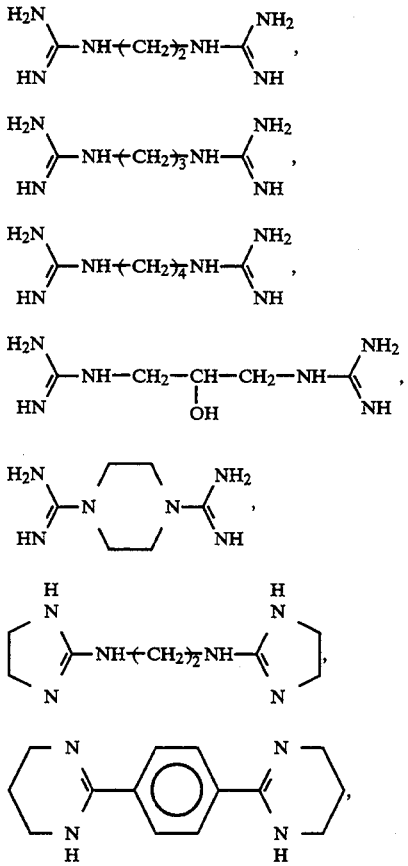

-continued

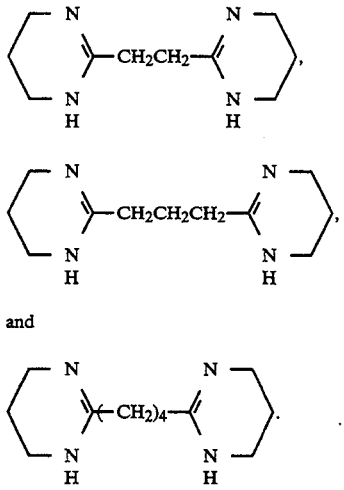

and

7. A method for forming an image in a silver halide color photographic material as claimed in claim 1, wherein the amidine compound or the bisguanidine compound is present in the processing solution containing a bleaching ability in an amount of 0.001 to 1 mol/l.

8. A method for forming an image in a silver halide color photographic material as claimed in claim 1, wherein the amidine compound or the bisguanidine compound is present in the processing solution containing a bleaching ability in an amount of 0.01 to 0.2 mol/l.

9. A method for forming an image in a silver halide color photographic material as claimed in claim 1, wherein the desilverization treatment comprises processing in a bleaching-fixing solution or processing in a processing solution having a bleaching ability and processing in a fixing solution, and the replenishment rate of the bleaching-fixing solution or the fixing solution is 120 ml per m$^2$ or less.

10. A method for forming an image in a silver halide color photographic material as claimed in claim 1, wherein any two of $R^1_n$, $R^2_n$, $R^3_n$ and $X_n$ may combine together to form a ring via a single bond.

11. A method for forming an image in a silver halide color photographic material comprising a support having thereon at least one light-sensitive silver halide emulsion layer which comprises image-wise exposing the silver halide color photographic material, color developing the exposed material in a color developing solution, and then subjecting the developed material to a desilverization treatment, wherein the desilverization treatment is carried out in the presence of a stilbene fluorescent brightener by using a desilverization bath having a bleaching ability and containing at least one of an amidine compound or a bisguanidine compound and a ferric salt of an organic acid, wherein the amidine compound or the bisguanidine compound is a compound represented by the following general formula (1):

$$B_nA \qquad (1)$$

wherein n represents an integer of 1 to 4; when n=1, A represents a hydrogen atom or an amino group, and B represents a residue formed by removing one hydrogen atom from an amidine represented by the following general formula (2); and when n≧2, A represents an n-valent organic residue having 10 carbon atoms or less, and B represents a residue formed by removing one hydrogen atom from an amidine or guanidine represented by the following general formula (2):

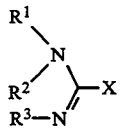

(2)

wherein $R^1$, $R^2$ and $R^3$ may be the same or different and each represents a hydrogen atom or an alkyl group having not more than 6 carbon atoms; X represents a hydrogen atom, an amino group, an alkyl group, an aryl group or a heterocyclic group, and each of these groups has 8 carbon atoms or less; or any two of $R^1_n$, $R^2_n$, $R^3_n$ and $X_n$ (wherein n is as defined above) may combine together to form a ring.

12. A method for forming an image in a silver halide photographic material as claimed in claim 11, wherein the light-sensitive silver halide emulsion comprises silver halide grains having a silver chloride content of at least 90 mol %.

13. The method for forming an image in a silver halide color photographic material as claimed in claim 11, wherein the fluorescent brightener is a compound of the formula (3):

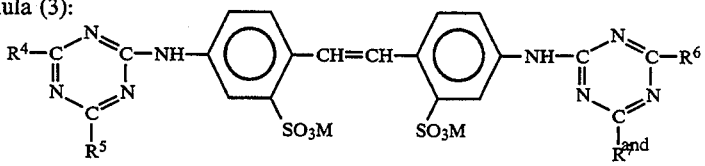

(3)

wherein $R^4$, $R^5$, $R^6$ and $R^7$ each represents a hydroxyl group, a halogen atom, a morpholino group, an alkyl group, an alkoxy group, an aryloxy group, an aryl group, an amino group, an alkylamino group or an arylamino group; and M represents a hydrogen atom, an alkali metal cation or a quaternary ammonium ion.

14. A method for forming an image in a silver halide color photographic material as claimed in claim 11, wherein the amidine compound or the bisguanidine compound has an acid dissociation constant (pKa) of at least 11.0 as measured at 25° C. in an aqueous solution.

15. A method for forming an image in a silver halide color photographic material as claimed in claim 11, wherein the amidine compound or the bisguanidine compound is selected from the group consisting of:

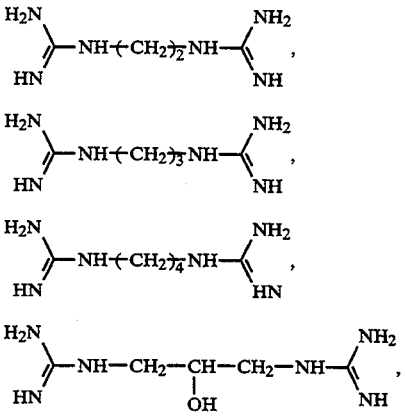

-continued

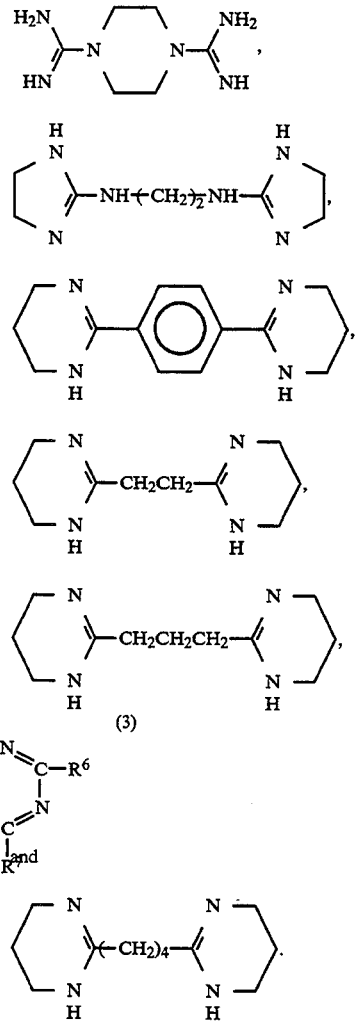

16. A method for forming an image in a silver halide color photographic material as claimed in claim 11, wherein the amidine compound or the bisguanidine compound is present in the desilverization bath in an amount of 0.001 to 1 mol/l.

17. A method for forming an image in a silver halide color photographic material as claimed in claim 11, wherein the amidine compound or the bisguanidine compound is present in the desilverization bath in an amount of 0.01 to 0.2 mol/l.

18. A method for forming an image in a silver halide color photographic material as claimed in claim 11, wherein the desilvering bath contains a stilbene fluorescent brightener in an amount of from $1\times10^{-4}$ to $5\times10^{-2}$ mol/l.

19. A method for forming an image in a silver halide color photographic material as claimed in claim 11, wherein the desilverization treatment comprises processing in a bleaching-fixing solution or processing in a processing solution having a bleaching ability and processing in a fixing solution, and the replenishment rate of the bleaching-fixing solution or the fixing solution is 120 ml per $m^2$ or less.

20. A method for forming an image in a silver halide color photographic material as claimed in claim 11, wherein any two of $R^1_n$, $R^2_n$, $R^3_n$ and $X_n$ may combine together to form a ring via a single bond.

* * * * *